US006883811B2

(12) United States Patent
Tlucko

(10) Patent No.: US 6,883,811 B2
(45) **Date of Patent: *Apr. 26, 2005**

(54) SKATE WITH PIVOTING FRONT CARRIAGE

(76) Inventor: Juraj George Tlucko, 183 Main St., Boxford, MA (US) 01921

( * ) Notice: Subject to any disclaimer, the term of this patent is extended or adjusted under 35 U.S.C. 154(b) by 205 days.

This patent is subject to a terminal disclaimer.

(21) Appl. No.: 10/218,062

(22) Filed: Aug. 12, 2002

(65) Prior Publication Data

US 2003/0052463 A1 Mar. 20, 2003

Related U.S. Application Data

(63) Continuation-in-part of application No. 09/699,149, filed on Oct. 28, 2000, now Pat. No. 6,431,559, which is a continuation-in-part of application No. 09/344,589, filed on Jun. 25, 1999, now Pat. No. 6,270,088.

(60) Provisional application No. 60/090,804, filed on Jun. 26, 1998.

(51) Int. Cl.[7] ..... A63C 17/02

(52) U.S. Cl. ..... 280/11.224; 280/11.27

(58) Field of Search ..... 280/8, 10, 11.19, 280/11.221, 11.223, 11.224, 11.27, 11.3, 841, 11.12, 11.14, 11.18, 11.28, 614, 7.13

(56) References Cited

U.S. PATENT DOCUMENTS

| | | | | |
|---|---|---|---|---|
| 576,106 A | * | 2/1897 | Frankenberg et al. | 280/7.13 |
| 628,433 A | * | 7/1899 | Finch | 280/7.13 |
| 1,228,544 A | | 6/1917 | Falstrem et al. | |
| 1,751,692 A | | 3/1930 | Fruhbeis | |
| 2,093,915 A | * | 9/1937 | Klevstad | 280/11.14 |
| 3,152,812 A | * | 10/1964 | Cummings | 280/11.19 |
| 3,649,038 A | * | 3/1972 | Huckenbeck | 280/11.28 |
| 4,272,090 A | | 6/1981 | Wheat | |
| 4,396,204 A | | 8/1983 | Smirnykh | |
| 5,135,244 A | | 8/1992 | Allison | |
| 5,257,793 A | | 11/1993 | Fortin | |
| 5,342,071 A | | 8/1994 | Soo | |
| 5,405,156 A | | 4/1995 | Gonella | |
| 5,503,413 A | | 4/1996 | Belogour | |
| 5,634,648 A | | 6/1997 | Tonel et al. | |
| 5,704,620 A | | 1/1998 | Oliemans et al. | |
| 5,732,957 A | * | 3/1998 | Yu | 280/11.19 |
| 5,816,588 A | * | 10/1998 | Nicoletti | 280/11.231 |
| 5,823,543 A | | 10/1998 | Burns et al. | |
| 5,842,706 A | | 12/1998 | Chang | |
| 5,890,724 A | | 4/1999 | Gignoux et al. | |
| 5,904,359 A | | 5/1999 | Caeran et al. | |

(Continued)

FOREIGN PATENT DOCUMENTS

| | | |
|---|---|---|
| DE | 78733 | 1/1894 |
| EP | 0 795 348 A1 | 2/1997 |
| WO | WO 96/37269 A | 11/1996 |
| WO | WO 97/32637 A | 9/1997 |

*Primary Examiner*—Faye M. Fleming
(74) *Attorney, Agent, or Firm*—O'Connell Law Firm

(57) ABSTRACT

A skate with a main skate frame, a skate boot, and a carriage frame pivotally coupled to the main skate frame. At least one ground engaging member, such as a wheel or a runner blade, is coupled to the carriage frame for pivoting therewith. The main skate frame can pivot laterally, dorsally, or both laterally and dorsally relative to the carriage frame. Lateral pivoting can be achieved, for example, with a lateral pivot shaft or with an arcuate passage with a plurality of axles that also enable dorsal pivoting.

45 Claims, 28 Drawing Sheets

U.S. PATENT DOCUMENTS 5,957,470 A 9/1999 Powell
5,979,916 A 11/1999 Gatel et al.
6,007,075 A * 12/1999 Shum ..... 280/11.12
6,017,041 A 1/2000 Gignoux
6,056,299 A 5/2000 Soo
6,082,744 A * 7/2000 Allinger et al. ..... 280/11.12
6,116,620 A * 9/2000 Gabrielli ..... 280/11.19
6,152,458 A * 11/2000 Edauw et al. ..... 280/11.14
6,193,243 B1 * 2/2001 Johannes Meester et al. ..... 280/11.221
6,217,036 B1 * 4/2001 Rowledge ..... 280/11.15
6,270,088 B1 * 8/2001 Tlucko ..... 280/11.221
6,398,229 B1 * 6/2002 Saylor ..... 280/11.19
6,431,559 B1 * 8/2002 Tlucko ..... 280/11.221

* cited by examiner

SKATE WITH PIVOTING FRONT CARRIAGE

This Application is a continuation in-part of application Ser. No. 09/699,149, filed Oct. 28, 2000, now U.S. Pat. No. 6,431,559, which is a continuation-in-part of application Ser. No. 09/344,589, filed on Jun. 25, 1999, now U.S. Pat. No. 6,270,088, which claimed the benefit of U.S. Provisional Application No. 60/090,804, filed Jun. 26, 1998.

FIELD OF THE INVENTION

The present invention relates generally to skating. More particularly, disclosed herein is a skate with a front carriage that is pivotally retained relative to a skate frame for improving the efficiency of each skating stroke.

BACKGROUND OF THE INVENTION

During skating, whether it be in-line or on ice, propulsion is achieved most effectively when the entire ground-engaging base, such as all of the wheels or the entire blade, of the skate in contact with the ground surface on which the skater is propelled. With the entire ground-engaging base of the skate in contact with the ground, the skater's leg enjoys a stability that allows it to drive with virtually unlimited force with little or no effort required for stabilizing the skate.

However, the experienced skater will be aware that it is substantially impossible for the skater to keep the entire ground-engaging base of the skate in contact with the ground surface over the entire skating stroke. Doing so is particularly problematic during the final phase of leg extension. As the leg enters its final stage, the rear wheels of the skate or the rear portion of the skate blade inevitably will follow the skater's heel in lifting off of the ground surface. With this, since the wheels or the blade are fixed in position relative to the skater's foot, only the foremost wheel or blade portion remains in contact with the ground. Consequently, it becomes the skater's only means of applying a driving force to the ground and stabilizing the skater's leg. Disadvantageously, skaters are thus unable to transmit all available energy from their legs to the ground surface.

Ice skates have been disclosed with blades having convex edges so that an increased portion of the blade will have contact with the ice surface at the end of the skating stroke. Other ice skates have been developed that allow a pivoting of the skate blade relative to the skate boot whereby the skate blade exhibits improved contact with the ice surface over final phase of leg extension. As one knowledgeable regarding the sport of speed skating will be well aware, this construction has proven to be a decided advantage over prior art fixed blade constructions.

The present inventor has appreciated that attempting to produce a convex blade profile with in-line skate wheels would require superfluous weight in wheels that would have only relatively minimal contact with the ground and that attempting to provide an in-line skate with an all-wheel pivoting blade structure has proven to be unacceptable due to vibrations, undesirable weight and leg stress, and unmanageably complex mechanical requirements. With these things in mind and with his own U.S. Pat. No. 6,270,088, which is expressly incorporated herein by reference, the inventor has provided an advance in the art of in-line skates by disclosing an in-line skate construction wherein a carriage frame with a plurality of wheels is pivotally coupled to a skate body adjacent to an anterior or forward end of the skate body while a group of one or more fixed wheels is coupled to the skate body.

By employing such an arrangement, the skater can enjoy increased stability and an improved ability to impart propulsive force. With this, more efficient and comfortable skating can be achieved. Even further, in his U.S. application Ser. No. 09/699,149, which is also incorporated herein by reference, the present inventor disclosed and protected, among other things, a plurality of methods and arrangements for manipulating the location of an effective pivot axis that is physically displaced from a pivoting mechanism. Under such embodiments of the invention, the vertical and horizontal locations of the effective pivot axis can be controlled to produce a most efficient skating stroke.

It has nonetheless become apparent to the present inventor that the foregoing concepts and still further developments can find application relative to skates designed for use on ice and also relative to in-line skates.

SUMMARY OF THE INVENTION

The present invention, therefore, is founded on the basic object of providing ice and in-line skate constructions that provide advantages beyond those disclosed by the prior art. A more particular principal object of the invention is to provide ice and in-line skate constructions that provide an extended skating stroke. A further object of the invention is to provide in-line and ice skates that provide for an efficient transmission of force from a skaters leg to the ground or ice on which the skater is propelled. Certainly these and further objects and advantages of the present invention will be obvious both to one who reviews the present specification and drawings and to one who has an opportunity to make use of an embodiment of the present invention.

The foregoing discussion merely outlines the more important objects of the invention to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF THE INVENTION

To ensure that one skilled in the art will fully understand and, in appropriate cases, be able to practice the present invention, certain preferred embodiments of the broader invention revealed herein are described below and shown in the accompanying drawing figures.

Figure 1:
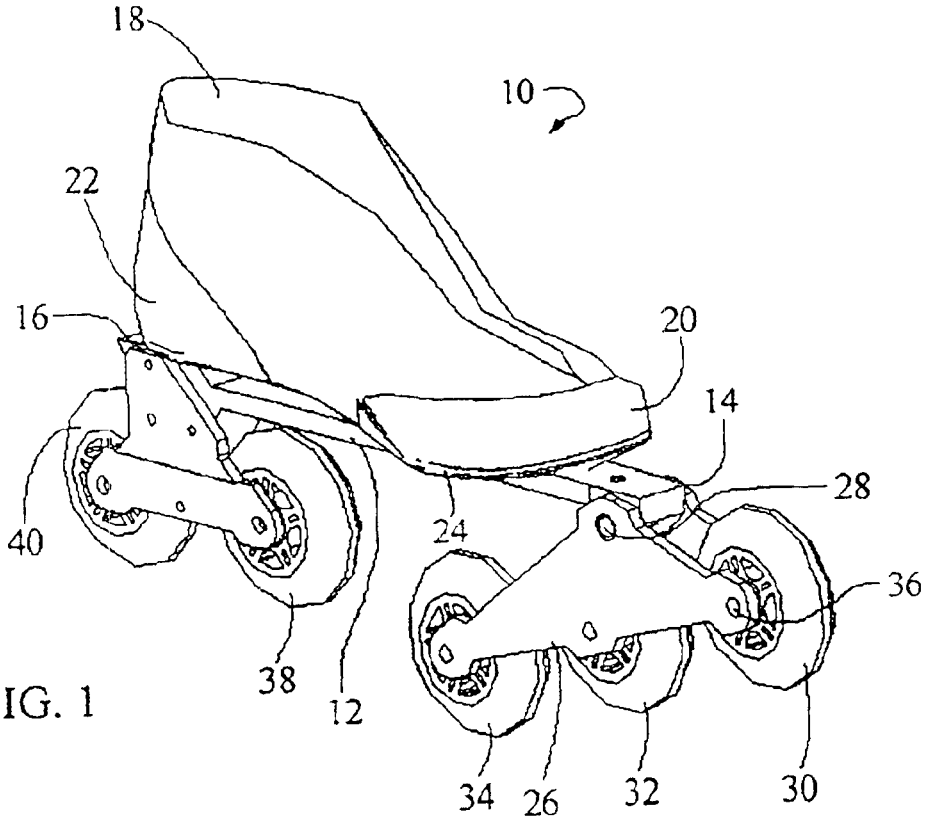
FIG. 1 is a perspective view of an in-line skate according to the present invention.

In FIG. 1, an in-line skate according to the present invention is indicated generally at 10. In FIG. 1, one sees that the in-line skate 10 is founded on a main skate frame 12 that has an anterior end 14 and a posterior end 16. A skate boot 18 with an anterior end 20 and a posterior end 22 is coupled to the main skate frame 12. The skate boot 18 also has a sole 24 and an open inner volume (not shown in FIG. 1) of a given length for receiving a skater's foot (not shown in FIG. 1). A carriage frame 26, which may be termed a sub-frame, is pivotally coupled to the main skate frame 12 to pivot about a pivot axis 28 adjacent to the anterior end 14 of the main skate frame 12.

First, second, and third wheels 30, 32, and 34 are rotatably coupled to the pivoting carriage frame 26 whereby the wheels 30, 32, and 34 comprise a pivoting wheel group. Each of the wheels 30, 32, 34, rotates about an axis 36. Fourth and fifth wheels 38 and 40 are rotatably coupled to the main skate frame 12 adjacent to the posterior end 16 of the main skate frame 12 whereby the fourth and fifth wheels 38 and 40 comprise a fixed wheel group. With the pivoting wheel group comprising three wheels 30, 32, and 34, the in-line skate 10 of this embodiment may be termed a competition in-line skate 10 as the traction and other performance characteristics that it would demonstrate would be most suitable for the performance requirements of a competition-level skater.

Under this arrangement, the pivoting wheel group can pivot with the carriage frame 26 relative to the main skate frame 12 to maintain contact with a ground surface (not shown) throughout a range of pivoting of the main skate frame 12 relative to the ground surface. As the astute observer will realize, the pivot axis 28 of the carriage frame 26 in this embodiment is anterior to the anterior end 20 of the skate boot 18, which has been found to extend the effective skating stroke as will be discussed in detail below.

Figure 2:
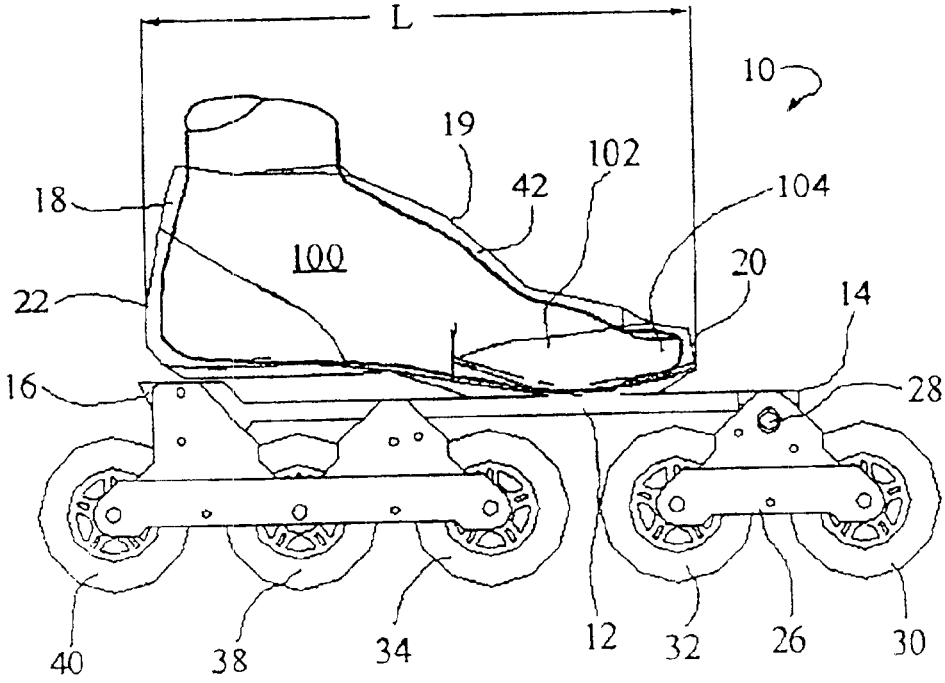
FIG. 2 is a view in side elevation of an alternative embodiment of an in-line skate embodying the present invention.

An alternative in-line skate is indicated again generally at 10 in FIG. 2. This embodiment again has first, second, third, fourth, and fifth wheels 30, 32, 34, 38, and 40. However, in this arrangement, the carriage frame 26 retains only first and second wheels 30 and 32 such that the pivoting wheel group comprises only those first and second wheels 30 and 32. Third, fourth, and fifth wheels 34, 38, and 40 are coupled to the main skate frame 12 to comprise the fixed wheel group. One again sees that the pivot axis 28 of the carriage frame 26 is anterior to the anterior end 20 of the skate boot 18 again for enabling an extended skating stroke. With five wheels 30, 32, 34, 38, 40 provided, the in-line skate 10 of this embodiment again may be considered a competition in-line skate 10.

In FIG. 2, where the shell 19 of the skate boot 18 is shown partially sectioned away, one sees the open inner volume 42, which is defined by the shell 19. In use, the skate boot 18 receives a skater's foot 100 into the open inner volume 42. The skater's foot 100 has a first metatarsophalangeal joint 102 about which the skater's first and largest toe 104 pivots. The inventor has discovered that providing an in-line skate 10 with a carriage frame 26 that pivots about a pivot axis 28 horizontally aligned with or anterior to the first metatarsophalangeal joint 102 provides a skater with an enhanced and lengthened skating stroke. Indeed, great advantage has been found to be achievable by locating the pivot axis 28 anterior to the anterior end 20 of the skate boot 18 as is illustrated in FIGS. 1 and 2.

On a typical foot, the first metatarsophalangeal joint 102 is located three-tenths of the overall length of the foot 100 from the tip of the first toe 104. Since the length L of the open inner volume 42 normally will approximate the length of the skater's foot 100, the pivot axis 26 preferably will be located coincident with or anterior to a reference point that is three-tenths of the overall length of the open inner volume 42 from the anterior end of the open inner volume 42 but not necessarily anterior to the anterior end 20 of the skate boot 18. As will be discussed more fully hereinbelow, the pivot axis 26 will be even more preferably coincident with or anterior to a reference point that is two-tenths of the overall length of the open inner volume 42 from the anterior end of the open inner volume 42, although not necessarily anterior to the anterior end 20 of the skate boot 18.

Figure 3:
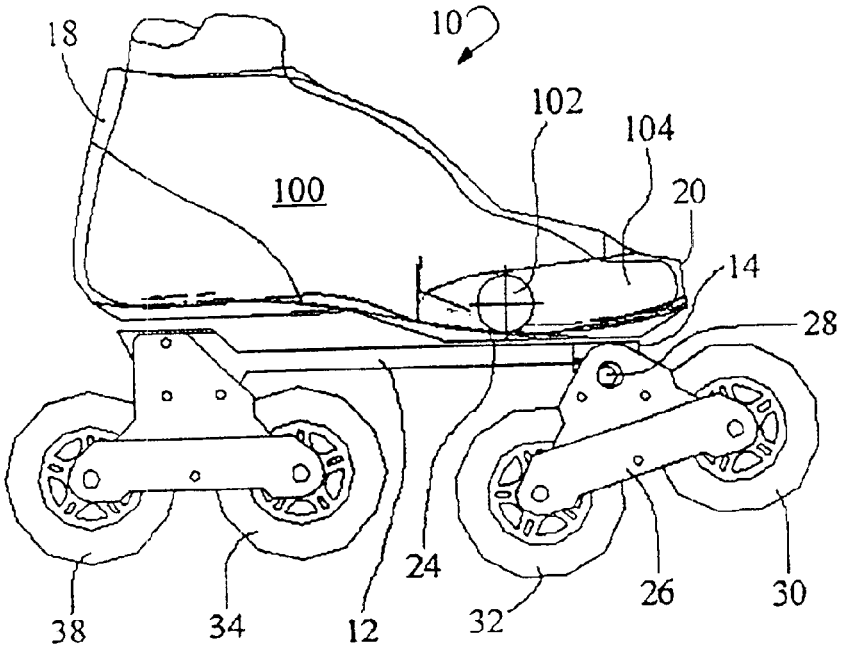
FIG. 3 is a view in side elevation of another alternative embodiment of the present invention for an in-line skate.

Such a possible construction of an in-line skate 10 is shown in FIG. 3. In this embodiment, first and second wheels 30 and 32 comprise the pivoting wheel group as they are rotatably mounted to the carriage frame 26. Third and fourth wheels 34 and 38 comprise the fixed wheel group as they are rotatably retained in a fixed position relative to the main skate frame 12. This recreational in-line skate 10 has just four wheels 30, 32, 34, and 38. The pivot axis 28 of the carriage frame 26 is located anterior to the reference point that comprises the first metatarsophalangeal joint 102 but posterior to the anterior end 20 of the skate boot 18.

The invention's aforedescribed manipulation of what may be considered the horizontal position of the pivot axis 28 certainly provides significant advantage over prior art in-line skates. However, the inventor has further discovered that prior art inline skates could be improved on even more significantly by also altering the vertical position of the pivot axis 28. Prior art in-line skates with a pivoting front wheel structure historically have disposed the pivot axis 28 well below the sole 24 of the skate boot 18. With this, a careful consideration of the geometry of such skates will reveal that the pivot axis 28 actually moves rearward relative to the skater's foot 100 as the heel of the skate is lifted from the ground. This rearward movement further limits the effective length of the skating stroke.

Figure 4:
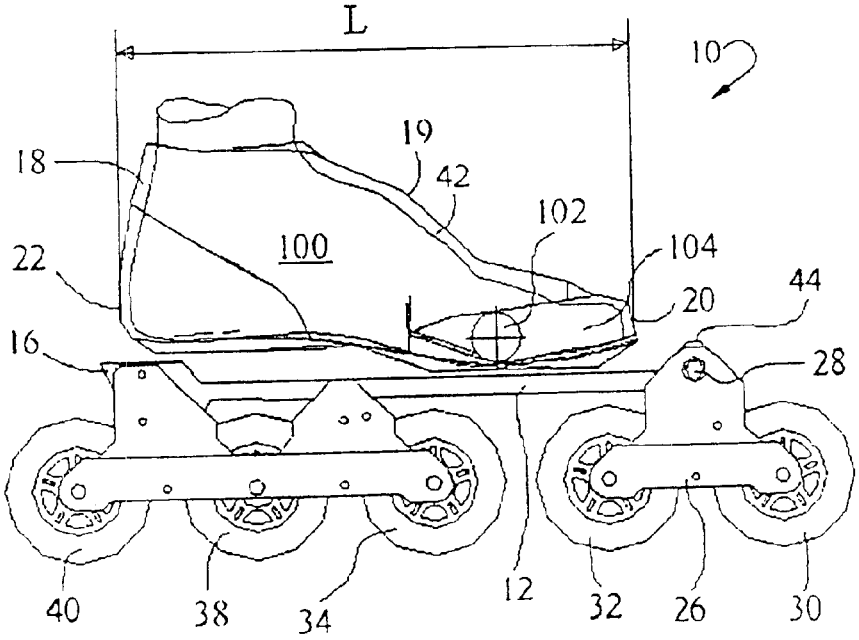
FIG. 4 is a view in side elevation of still another alternative embodiment of the present invention.
Figure 5:
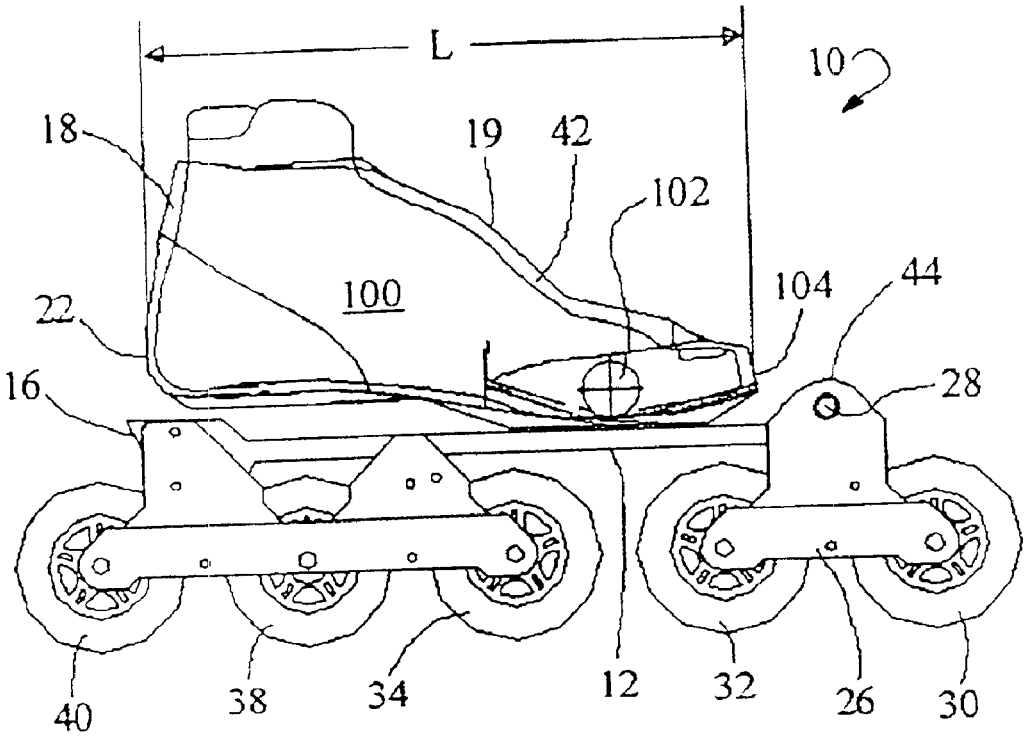
FIG. 5 is a view in side elevation of yet another embodiment of the present invention for an in-line skate.

Under this first embodiment of the present invention, however, the pivot axis 28 of the in-line skate 10 is displaced to a position nearly coincident with the upper edge of the main skate frame 12 as is shown in FIGS. 1, 2, and 3. As a result, the vertical position of the pivot axis 28 is immediately adjacent to the sole 24 of the skate boot 18. With this, the rearward distance that the pivot axis 28 moves as the main skate frame 12 is rotated relative to a ground surface can be minimized or eliminated.

Where possible, however, possibly greater advantage can be achieved by locating the pivot axis 28 even higher than the position shown in FIGS. 1, 2, and 3. For example, the pivot axis 28 could be approximately coincident with the sole 24 of the skate boot 18. This certainly could be accomplished in a number of ways. For example, as FIG. 4 shows, the main skate frame 12 could have an enlarged portion 44 disposed adjacent to the anterior end 14 of the main skate frame 12. The enlarged portion 44 could retain the pivot axis 28. Also, as FIG. 5 shows, the pivot axis 28 could be adjusted to be above the sole 24 of the skate boot 18, which may be considered distal to the sole 24 of the skate boot 18 relative to the wheels 30, 32, 34, 38, and 40 of the in-line skate 10.

Figure 6:
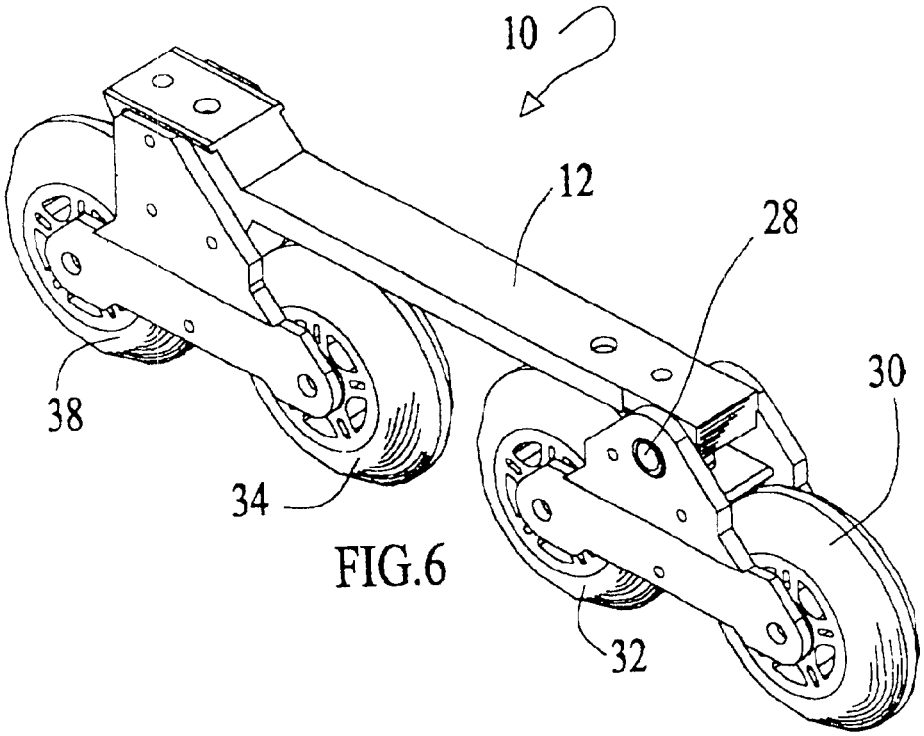
FIG. 6 is a perspective view of the in-line skate of FIG. 3 shown devoid of the skate boot.
Figure 7:
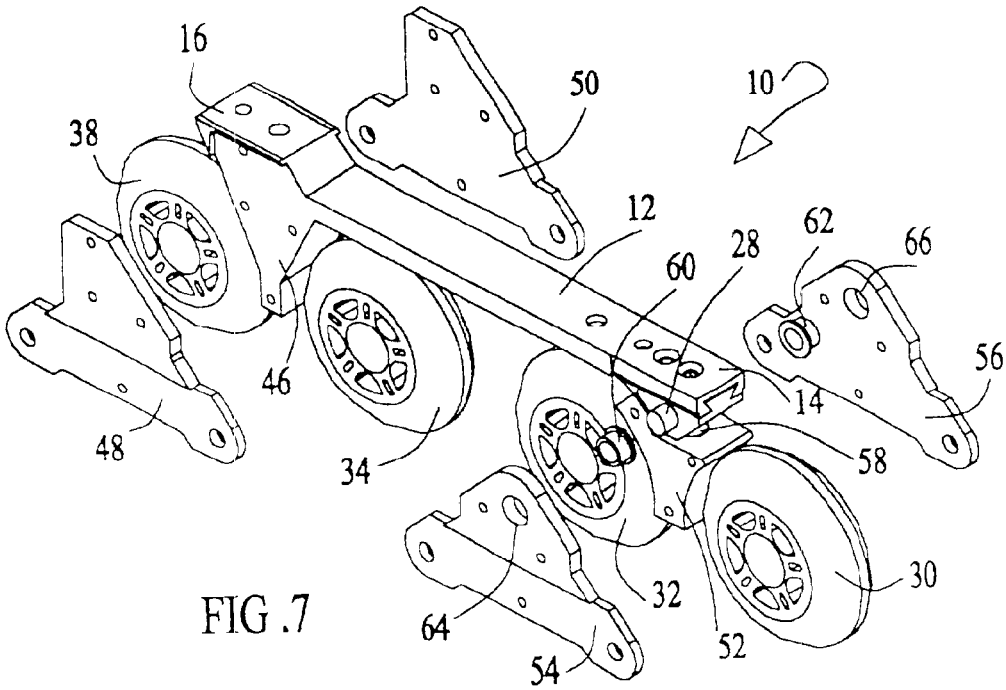
FIG. 7 is an exploded perspective view of the in-line skate of FIGS. 3 and 6.

For greatest clarity, the in-line skate 10 of FIG. 3 is shown in FIG. 6 devoid of the skate boot 18. Furthermore, FIG. 7 shows the in-line skate 10 of FIGS. 3 and 6 in an exploded view. In FIG. 7, one sees that the main skate frame 12 comprises an elongate member. As such, the main skate frame 18 provides a rigid supporting structure for all of the wheels 30, 32, 34, and 38 such that the wheels 30, 32, 34, and 38 maintain perfect alignment even with a pivoting of the carriage frame 26. This is an important advantage over prior art skates (not shown) that have mounted a pivoting carriage and a fixed carriage separately to a skate boot, which could permit the wheels 20, 32, 34, and 38 to become misaligned.

In any event, from FIGS. 6 and 7, one sees that the main skate frame 18 has a mounting block 46 that projects downwardly between the third and fourth wheels 34 and 38. Mounting plates 48 and 50 sandwich the mounting block 46 and the third and fourth wheels 34 and 38. The mounting plates 48 and 50 act as the means by which the third and fourth wheels 34 and 38 are retained relative to the main skate frame 12 by axles (not shown). The mounting plates 48 and 50 are fixed in place relative to the mounting block 46 by bolts (not shown) or any other appropriate fastening means.

In a similar manner, a spacer block 52 projects downwardly from adjacent to the anterior end 14 of the main skate frame 12 and is pivotally coupled thereto at the pivot axis 28. Mounting plates 54 and 56 sandwich the spacer block 52 and the first and second wheels 30 and 32. The mounting plates 54 and 56 thus act as the means by which the third and fourth wheels 30 and 32 are pivotally retained relative to the main skate frame 12 by axles (not shown). The mounting plates 54 and 56 are fixed in place relative to the spacer block 52 by bolts (not shown) or any other appropriate fastening means.

Bearings 60 and 62 surround the pivot axis 28 for enabling a smooth pivoting of the mounting plates 54 and 56. The pivot axis 28 projects from each side of the spacer block 52 an amount equal to the length of the bearings 60 and 62. The mounting plates 54 and 56 have axle apertures 64 and 66 into which the pivot axis 28 and the surrounding bearings 60 and 62 are received. Since a user might wish to adjust the horizontal location of the carriage frame 26 relative to the main skate frame 12, a plurality of attaching holes 55 can be provided on the main skate frame 12 to act as a means for adjusting the location of the carriage frame 26 relative to the main skate frame 12. Although not shown, the carriage frame 26 typically will be fixed in place by bolts in combination with the attaching holes 55.

To ensure that the pivoting wheel group is properly disposed for the beginning of each skating stroke, a biasing means in the form of a compression spring 58 may be interposed between the main skate frame 12 and the spacer block 52 for biasing the first and second wheels 30 and 32 into the disposition shown in FIG. 7. Of course, a wide variety of alternative biasing means will be obvious to one skilled in the art. For example, the inventor has further discovered that one could bias the carriage frame 26 toward the disposition of FIG. 7 by employing a solid axle relative to the first wheel 30 and a hollow or otherwise lighter axle relative to the second wheel 32. With this, with the pivot axis 28 centered between the wheels 30 and 32, the weight differential in the carriage frame 26 will induce the carriage frame to the disposition of FIG. 7. It is also possible, although not shown, to bias the carriage frame 26 by moving the pivot axis 28 rearward from its illustrated location centered between the first and second wheels 30 and 32.

Figure 8:
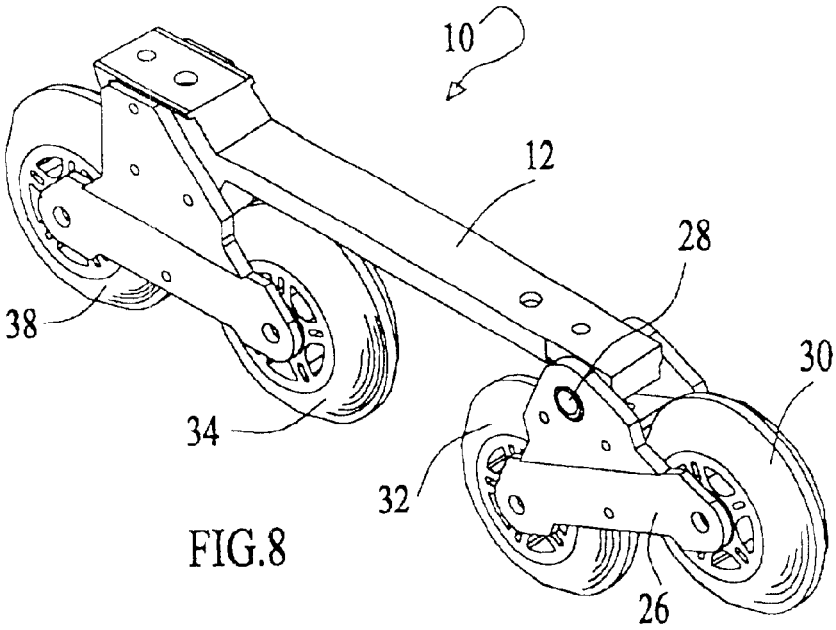
FIG. 8 is a perspective view of the in-line skate of FIGS. 3, 6, and 7 with the front wheels in a pivoted position.
Figure 9:
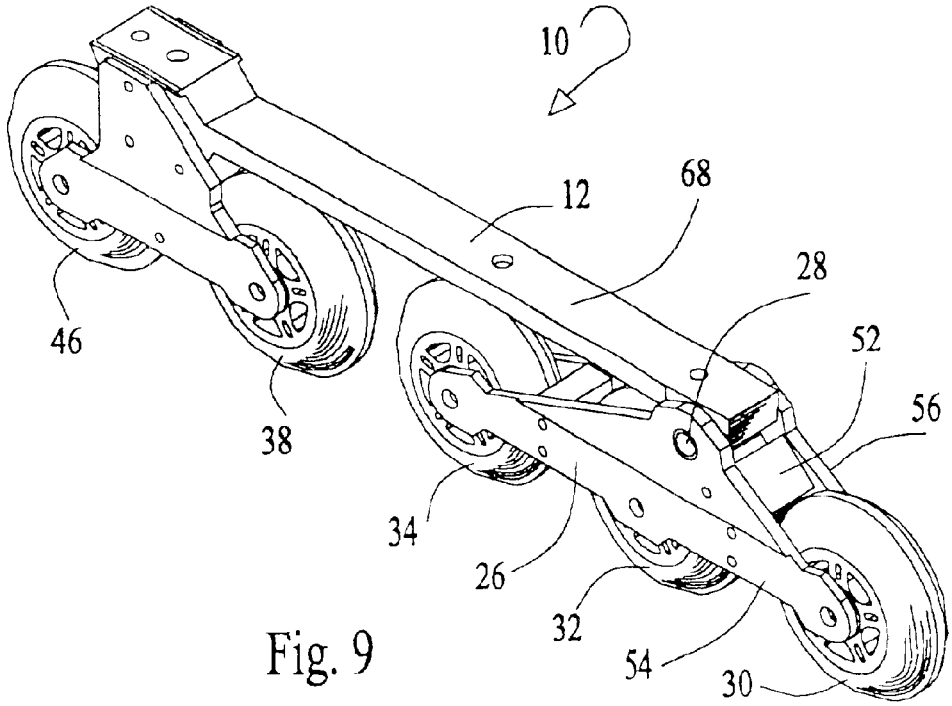
FIG. 9 is a perspective view of the in-line skate of FIG. 1 shown devoid of the skate boot.
Figure 10:
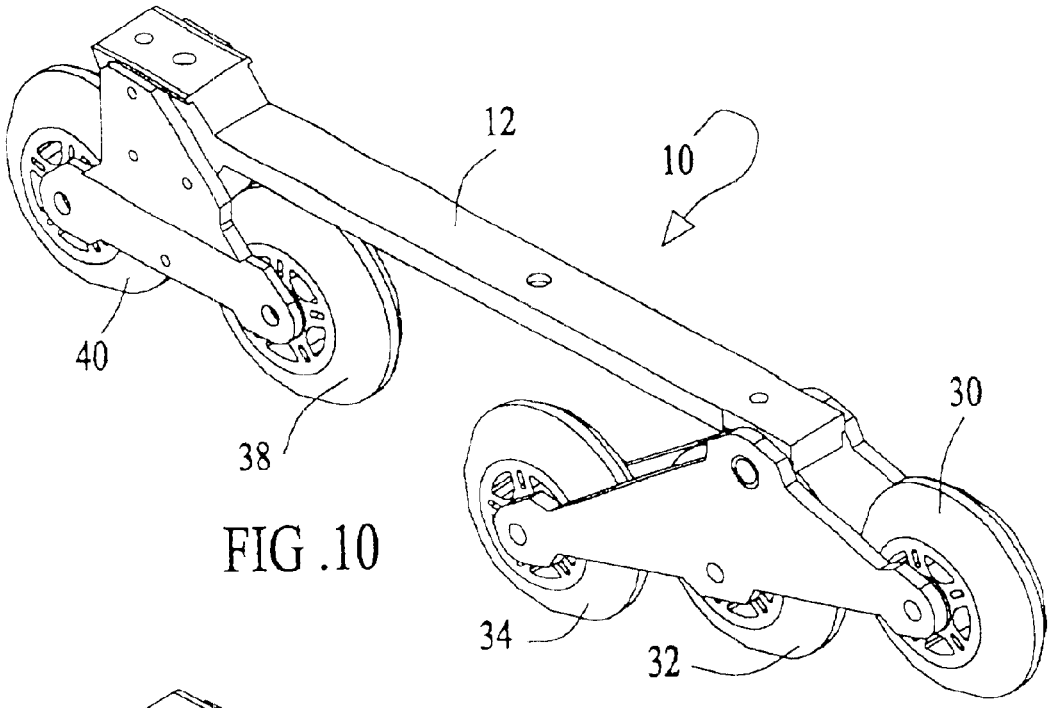
FIG. 10 is a perspective view of the in-line skate of FIGS. 1 and 9 with the front wheels in a pivoted position.
Figure 11:
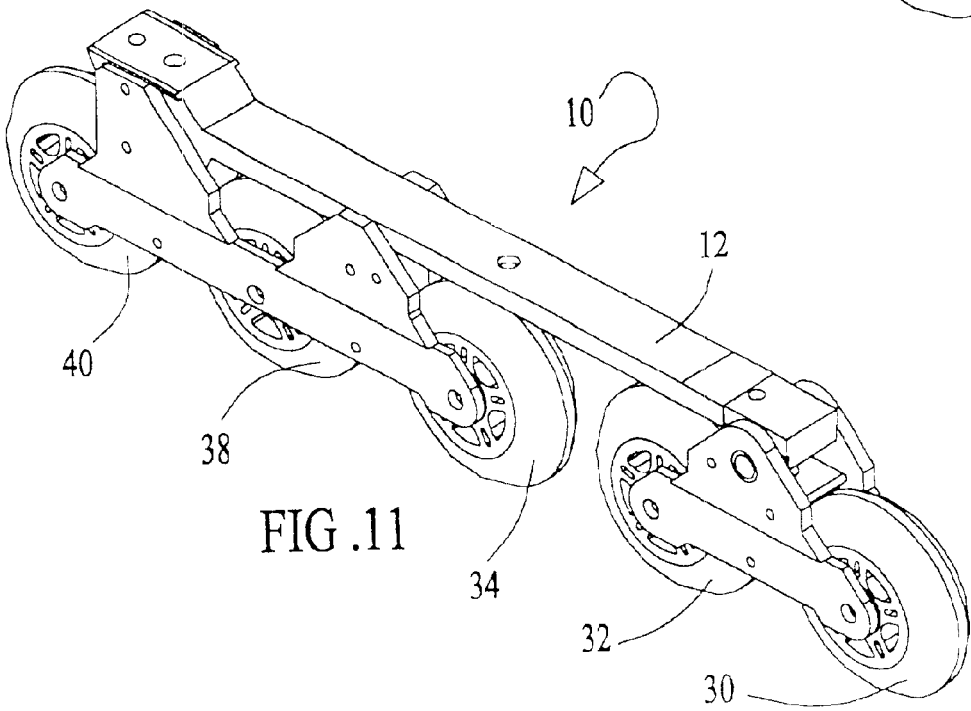
FIG. 11 is a perspective view of the in-line skate of FIG. 2 shown devoid of the skate boot.

FIG. 8 shows the in-line skate 10 with the first and second wheels 30 and 32 in a pivoted disposition relative to the main skate frame 12. Also, FIG. 9 shows the embodiment of the in-line skate 10 of FIG. 1 devoid of the skate boot 18. In this embodiment, another spacer block 68 is interposed between the mounting plates 54 and 56. Still further, FIG. 10 shows the in-line skate 10 with the first, second, and third wheels 30, 32, and 34 pivoted relative to the main skate frame 12. Still further, FIG. 11 shows the five-wheel embodiment of the in-line skate 10 of FIG. 2 devoid of the skate boot 18.

Figure 13:
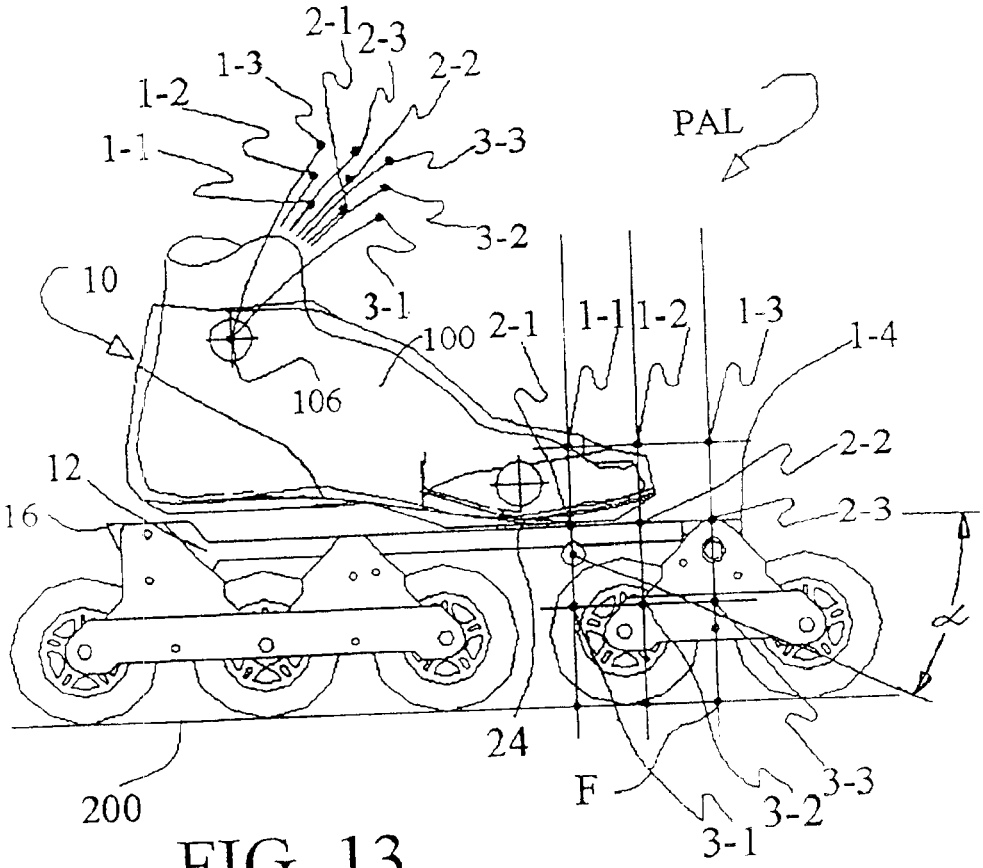
FIG. 13 is a view in side elevation of the in-line skate of FIG. 2 with possible pivot axis locations indicated.
Figure 14:
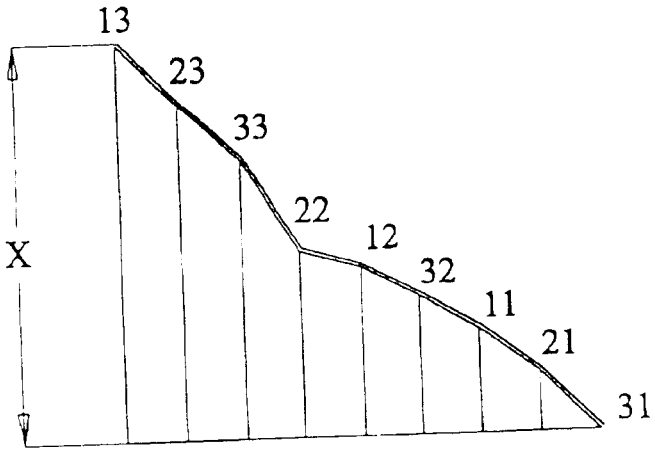
FIG. 14 is a graphical depiction of the differences in distance between the pivot axis of a subject's ankle and a reference point on a ground surface depending on the relative location of the pivot axis of the carriage frame.

FIGS. 13 and 14 together provide demonstrative evidence of the benefits to be achieved by locating the pivot axis 28 in the manner taught by the present invention. In FIG. 13, one sees what is essentially the in-line skate of FIG. 2 again with a skater's foot 100 disposed therein. Adjacent to the anterior end 14 of the main skate frame 12, FIG. 13 shows nine possible locations for the pivot axis 28 employing reference numbers 1-1, 1-2, 1-3, 2-1, 2-2, 2-3, 3-1, 3-2, and 3-3. The pivot axis 106 of the subject's ankle is shown as it would be located with the main skate frame 12 flat relative to a ground surface 200.

Above the illustrated pivot axis 106, one sees for each possible location of the pivot axis 28 (with corresponding reference numbers) where the pivot axis 106 or ankle joint 106 would be if the main skate frame 12 were rotated a given angle relative to the ground surface 200 with the first and second wheels 30 and 32 maintaining contact with the ground surface 200. As the astute observer will realize, location 3-1, which is below the sole 24 of the skate boot 18 and not far in advance of the pivot axis 102 of the first metatarsophalangeal joint 102, would appear to yield the shortest effective increase in skating stroke length. On the other hand, location 1-3, which is well above the sole 24 of the skate boot 18 and well anterior to the anterior end of the skate boot 18, clearly yields the longest effective increase in skating stroke length.

The actual advantages in distance between a reference point F on the ground surface 200 and the pivot axis 106 of the subject's ankle are graphically shown in FIG. 14 where they are indicated at X. In one particularly dimensioned embodiment of the invention, the distance between the pivot axis 106 and the reference point F increased by a distance X of nearly three and one-third inches between the reference point 3-1 and the reference point 1-3. The reference point F may be considered the final push-off point of the pivoting in-line skate 10 and may be considered centered between the pivoting wheels 30 and 32 along a shared tangent thereto.

Based on this present understanding of the advantages of his invention, the instant inventor has determined that the pivot axis 28 would be located most preferably in what may be termed a Preferred Axis Location PAL area of FIG. 13. This PAL area is defined as the area between a vertical line drawn upwardly from the reference point 3-1 and a line extending along a downward angle $\alpha$. The angle $\alpha$ has been determined to approximate most advantageously twenty-five (25) degrees below horizontal as determined when the in-line skate 10 is disposed in full contact with a ground surface.

In the preferred embodiment of FIG. 13, reference point 3-1 is located at least horizontally coincident with or anterior to a location of the first metatarsophalangeal joint 102, which typically will be at or anterior to a location 0.30 times the overall length of the skate boot 18 from the anterior end 20 of the skate boot 18. More preferably, though, the reference point 3-1 will be located at least horizontally coincident with or anterior to a location 0.20 times the overall length of the skate boot 18 from the anterior end 20 of the skate boot 18. Of course, under this present understanding of the invention, the reference point 3-1 will be located for greatest advantage anterior to the anterior end 20 of the skate boot 18.

As was mentioned previously, the vertical location of the reference point 3-1 also has a direct effect on the skating stroke. Accordingly, the preferred reference point 3-1 will be located at least vertically coincident with or above a position three-quarters of an inch below the sole 24 of the skate boot 18. More preferably, the reference point 3-1 will be located at least vertically coincident with or above a position one-half of an inch below the sole 24 of the skate boot 18. Most preferably based on the present analysis, the reference point 3-1 will be located substantially coincident with or above the sole 24 of the skate boot 18.

Figure 12:
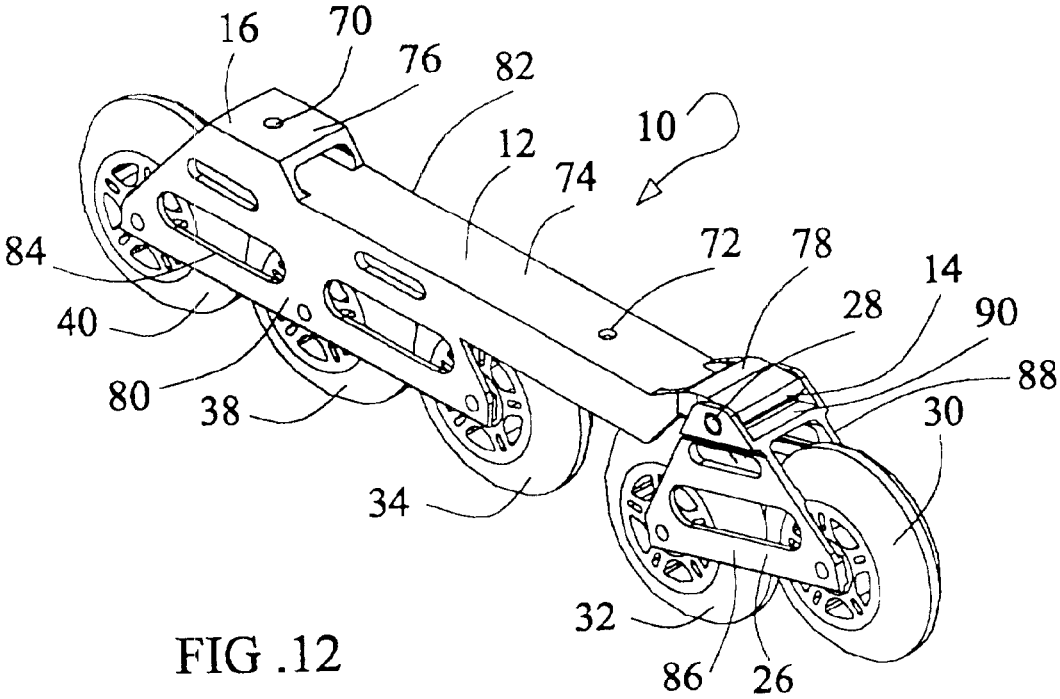
FIG. 12 is a perspective view of a main skate frame according to the present invention.

Looking next to FIG. 12, one sees a particularly preferred main skate frame 12 that provides a most advantageous location for the pivot axis 28. The main skate frame 12 has first and second fastening apertures 70 and 72 for fastening the main skate frame 12 to a skate boot (not shown). One major improvement depicted in the main skate frame 12 of FIG. 12 is that it is constructed as a one-piece design. It would presently appear preferable to form the unitary main skate frame 12 in an extrusion-and-cutting process. However, it should be clear that it would be well within the scope of the invention to form the structure in a stamping-and-bending process. With this, it can be exceedingly simple in manufacture yet extraordinarily rigid and durable in use.

The main skate frame 12 has a base plate 74 that is generally solid except for the second fastening aperture 72. A first side plate 80 is disposed in a plane generally perpendicular to the base plate 74 along a first side thereof, and a second, substantially identical side plate 82 is disposed in a plane generally perpendicular to the base plate 74 along a second side thereof. Consequently, the first and second side plates 80 and 82 are disposed in generally parallel planes, and the first and second side plates 80 and 82 and the base plate 74 together form what may be considered C-shaped channel. As one will appreciate, the first and second side plates 80 and 82 could extend slightly or even significantly above the base plate 74 distal to the third, fourth, and fifth wheels 34, 38, and 40 to cause the first and second side plates 80 and 82 and the base plate 74 to present an I-beam configuration.

The third, fourth, and fifth wheels 34, 38, and 40 are interposed between the first and second side plates 80 and 82, which essentially form the opposing jaws of the C shape. With this, the third, fourth, and fifth wheels 34, 38, and 40 contribute to the structural rigidity of the main skate frame 12. Although it is hidden in FIG. 12, also interposed between the first and second side plates 80 and 82 is a reinforcement plate that is disposed parallel to the base plate 74. In a manner illustrative of how the main skate frame 12 could be lightened, a plurality of cutouts 84 are disposed in the first and second side plates 80 and 82. Additional cutouts 84 could be disposed in the first and second side plates 80 and 82 and the base plate 74 provided that they do not detract from the required strength and rigidity of the structure.

An elevated mounting plateau 76 comprising a raised plate supported by a pair of side legs is disposed adjacent to the posterior end 16 of the main skate frame 12 for providing a heightened position for the first fastening aperture 70. In a similar manner, the anterior end 14 of the main skate frame 12 has an elevated retaining plateau 78 that rises above the base plate 74. By being located within the elevated retaining plateau 78, the pivot axis 28 is also disposed well above the base plate 74. With this and in light of the foregoing discussion of the benefits to be gained by advantageously locating the pivot axis 28, one will realize that the pivot axis 28 in FIG. 12 is in a particularly advantageous location. It is horizontally well anterior to where the toe of the skate boot would be located. Furthermore, it is vertically distal to where the sole of the skate boot would be relative to the first and second wheels 30 and 32 of the in-line skate 10.

Since the main skate frame 12 is formed by an extrusion-and-cutting process, one will appreciate that it is initially formed as a structure with a uniform cross section. That cross section is outlined by sides comprising the first and second side plates 80 and 82 and a top comprising what will ultimately form the elevated mounting plateau 76 the elevated retaining plateau 78. The base plate 74 will be disposed below and parallel to the top of the structure. Similarly, the reinforcement plate will be disposed below and parallel to the base plate 74. From this structure the ultimate main skate frame 12 will be cut. Certainly the main skate frame 12 could be formed from a variety of materials that would provide the required structural rigidity and durability. However, it presently appears preferable to form the main skate frame 12 and the carriage 26 from an aluminum alloy chosen for combined properties of strength, durability, and lightness. For example, 2024 and 7075 aluminum alloys presently appear desirable.

Much like the preferred main skate frame 12 of FIG. 12, the carriage 26 in FIG. 12 is also preferably formed by an extrusion-and-cutting process. It has a similar configuration to the main skate frame 12. First and second side plates 86 and 88 are formed integrally with a base plate 90. As with the main skate frame 12, the first and second side plates 86 and 88 are generally parallel to one another and perpendicular to the base plate 90. In the carriage 26, however, a portion of each of the first and second side plates 86 and 88 extends from base plate distal to the base plate 90 relative to the first and second wheels 30 and 32. With this, that portion of each side plate 86 and 88 acts as a means for retaining the pivot axis 28 above the sole of a skate boot (not shown) that is attached to the main skate frame 12 and well anterior to the toe of any such skate boot.

Figure 15:
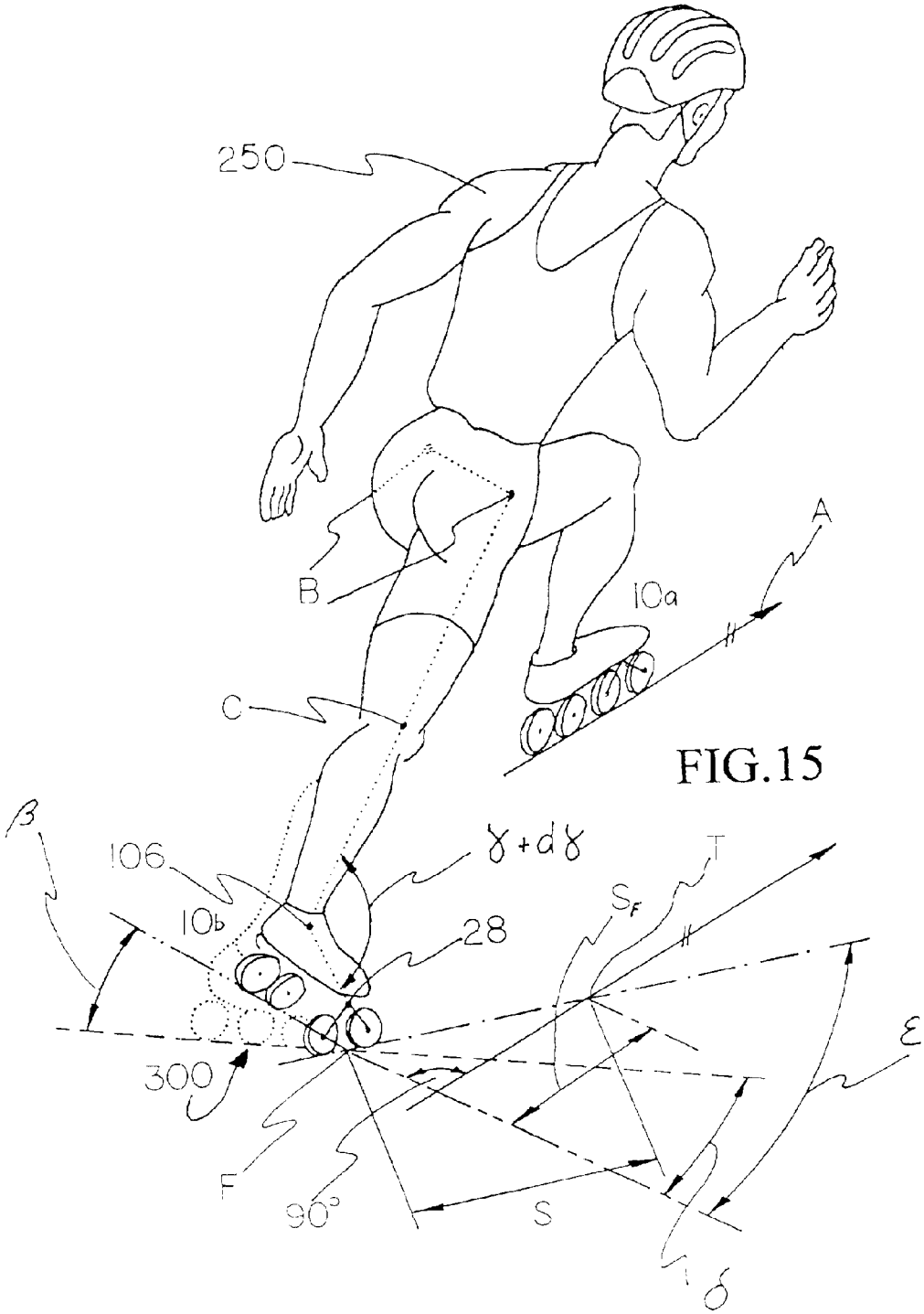
FIG. 15 is a perspective view of a skater wearing a pair of in-line skates according to the present invention depicting the advantages to be gained by the location of the present invention's pivot axis.

Although the foregoing discussion certainly makes clear that measurable advantages are to be gained by the present invention's advantageous locating of the pivot axis 28 of the carriage 26, one can gain an even more particular understanding of the nature of the advantages gained by reference to FIG. 15 and the ensuing discussion and formulae. In FIG. 15, an in-line skater 250 wears first and second inline skates 10*a* and 10*b* according to the present invention. The first in-line skate 10*a* is in an initial portion of the skating stroke while the second in-line skate 10*b* is disposed as it would be in a final portion of the skating stroke. Adjacent to the second in-line skate 10*b*, one sees in ghost format a prior art, non-pivoting in-line skate 300 as it would be oriented at the end of the skating stroke. The coincident location of the inline skates 10*b* and 300 in FIG. 15 may be considered to be where the advantages gained by the present invention become manifest in extending the skating stroke as herein described.

In FIG. 15, the line A indicates the direction of forward motion. The location of the in-line skater's 250 hip joint is indicated at B, and his knee joint is shown at C. The angle $\beta$ is what may be termed a space angle between a line drawn from the point F through the most distal point on the rearmost wheel of the in-line skate 10*b* or 300. With a pivoting in-line skate 10*b*, the point F may be considered centered between the pivoting wheels 30 and 32 along a shared tangent thereto. For the prior art skate 300, the point F may be considered the last point on the edge of the foremost wheel to leave the ground surface.

An angle $\gamma$ (not shown) is the angle between the in-line skater's 250 foot and shinbone with a prior art, non-pivoting in-line skate 300 when the skate is in a push-off position as shown in FIG. 15. The angle $\gamma$+d $\gamma$ in FIG. 15 represents the aforementioned angle $\gamma$ plus the additional extension d$\gamma$ provided to that angle $\gamma$ by providing the pivoting front carriage 26 according to the present invention. As one will see in FIG. 15, with the in-line skates 10*a* and 10*b* according to the present invention, the hip joint B, knee joint C, and ankle joint 106 are able to achieve an aligned configuration.

Figure 16:
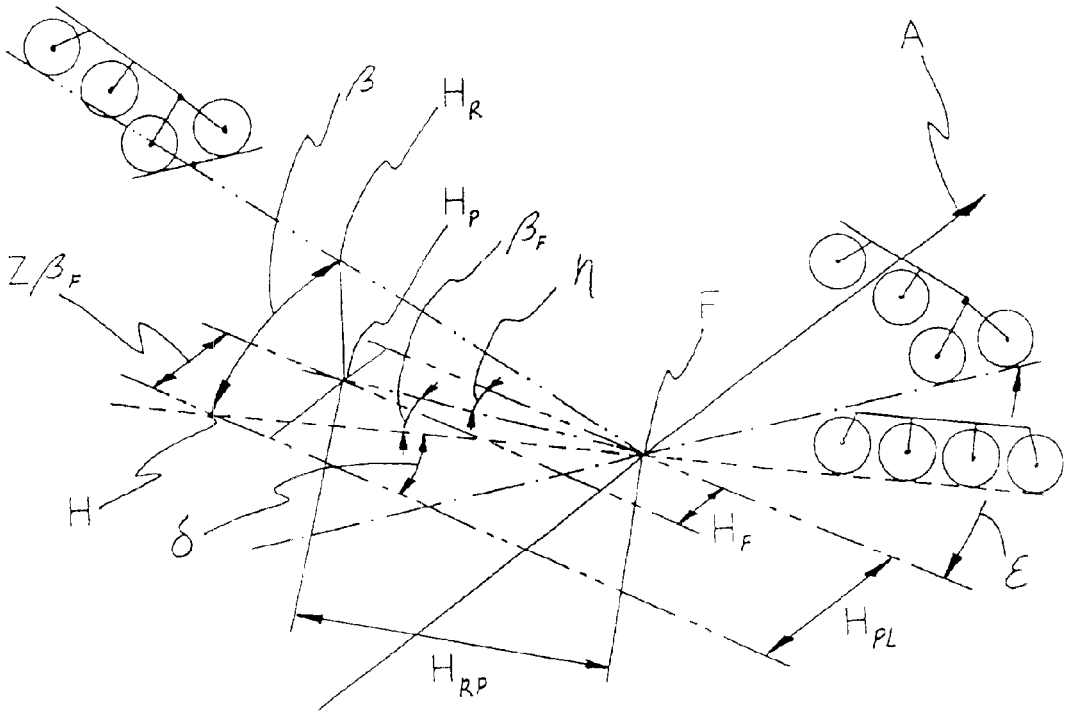
FIG. 16 is a schematic further depicting the advantages to be gained by locating the pivot axis according to the present invention.

One will appreciate that there is a forward gain in the position of the in-line skater's 250 ankle joint 106 along the line of travel A, which results in part from the angle $\beta$. In FIG. 16, one sees that this distance $Z\beta_f$ equals the result of subtracting the distance $H_F$ from the distance $H_{PL}$. $H_{PL}$ is the distance between points H and F along the direction of travel A, and it can be calculated as (sin $\delta$)(DH) where DH is the distance between the points H and F. $H_F$ equals the product of $(\sin_\eta)(H_{RP})$ where the angle $\eta$ equals the angle $\delta$ minus the angle $\beta_F$. Angle $\beta_F$ is a projection of the space angle $\beta$ in a horizontal plane.

$H_{RP}$ is a projection of the distance between the point $H_R$ and the point F in a horizontal plane. Point H is the location of the most distal point on the rearmost wheel on the prior art, non-pivoting in-line skate 300. Point $H_R$ is the location of that same point on a pivoting in-line skate 10*b* according to the present invention. Point $H_P$ is the projection of point $H_R$ in a horizontal plane.

In an attempt to produce greatest clarity, the plurality of lines in FIG. 16 are coded. The track of the non-pivoting skate 300 is indicated by a line of dashes of consistent length. The track of the pivoting skate 10*b* is indicated by a line of alternating dots and long dashes. The direction of forward motion A is indicated by a solid line. The direction perpendicular to the direction of forward motion A is indicated by a line of two short dashes interposed between long dashes. The direction of a rotated tangent of the pivoting in-line skate 10*b* around point F by the amount of the space angle $\beta$ is indicated by a line of two dots interposed between long dashes. Finally, the top projection of the rotated track of the pivoting in-line skate 10*b* around point F in a horizontal plane is indicated by a sequential series of a long dash, a short dash, and a dot.

In any event, one will further realize that the ankle joint 106 is moved forward an additional distance by the increase d$\gamma$ in the angle $\gamma$. This distance can be readily calculated in a similar manner as the distance $Z\beta_f$ was calculated above from the values given by $d\gamma_f$, the distances between the ankle joint 106 and the pivot axis 28 and between the ankle joint 106 and F, the orientation of the ankle joint 106 relative to the knee joint C, and the angles $\delta$ and $\epsilon$.

There is a further distance, S, to be considered, which is the additional distance that the present in-line skate 10 is able to travel along a ground surface due to the pivoting of the first and second wheels 30 and 32. One will appreciate that this distance S is a factor of the in-line skater's 200 velocity dV and the increased stroke time dT. The distance S can be given as the product of (dV)(dT). The distance S has a forward component $S_F$, which is equal to (sinϵ)(S). With this distance S, one sees that the in-line skate 10*b* of the present invention will actually have a final skating stroke position at the point T in FIG. 15. The in-line skates 300 and 10*b* are shown generally aligned in FIG. 15 merely to enable a clear comparison of the previously-described angles.

With this, the cumulation of the distance gains by the pivoting in-line skate 10 according to the present invention can be symbolized by E, which is the result of adding the variable and interrelated improvements $(Z\beta_f)+(Ld\gamma_f)+(X)+(S)$ where X is the distance given in FIG. 14. The astute observer will realize that the distances $(Z\beta_f)+(Ld\gamma_f)+(X)+(S)$ are indications of the gains that are available to one who makes use of the present invention. Of course, the corresponding dimensional gains that can be realized by each individual skater will depend on a plurality of factors including size, ability, strength, and effort.

In light of the advantages that they produce, it will certainly be appreciated that the enlarged portion 44 of FIGS. 4 and 5 and the elevated retaining plateau 78 of FIG. 12 are both viable structures for adjusting the vertical and horizontal locations of the pivot axis 28. However, at least in certain circumstances, it may be argued that such structures are amenable to improvement in that they add to the bulk and weight of the in-line skate 10. Furthermore, such structures impose practical limitations on where the pivot axis 28 can be located.

Advantageously, the inventor has conceived of even further embodiments of the invention that are able to manipulate the location of the pivot axis 28 while eliminating all need for structures such as the enlarged portion 44 and the elevated retaining plateau 78 that would otherwise be necessary for adjusting the vertical and horizontal locations of the pivot axis 28. In each such embodiment, the in-line skate 10 incorporates a pivoting mechanism that acts as a means for creating a physically displaced effective pivot axis, with the pivot axis again indicated at 28. As its name would suggest, the pivoting mechanism for creating a physically displaced effective pivot axis enables the in-line skate 10 to create an effective pivot axis 28 that is physically displaced from the moving contacts between the main skate frame 12 and the carriage frame 26. Indeed, these embodiments of the invention can allow the effective pivot axis 28 to be moved to locations physically displaced from, preferably vertically above, the carriage frame 26 and the main skate frame 12 without requiring that actual physical structure be located at the location of the effective pivot axis 28.

Figure 17:
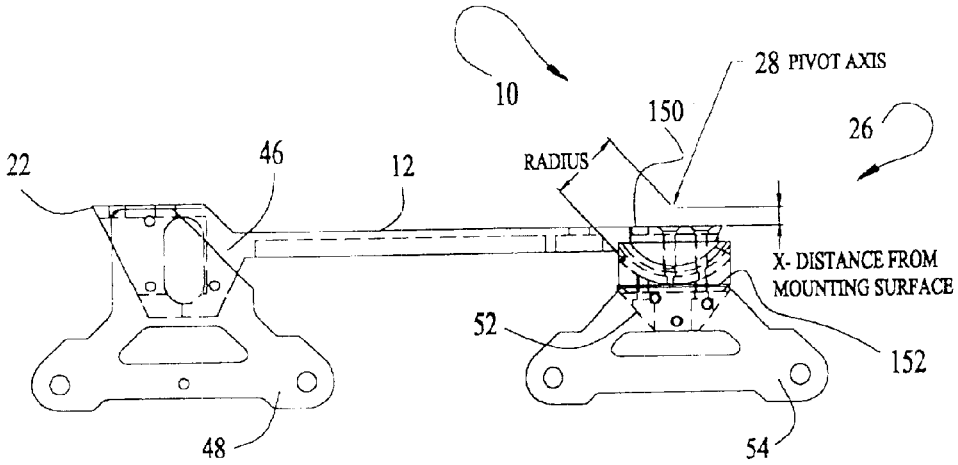
FIG. 17 is a view in side elevation of an alternative embodiment of the in-line skate.
Figure 18:
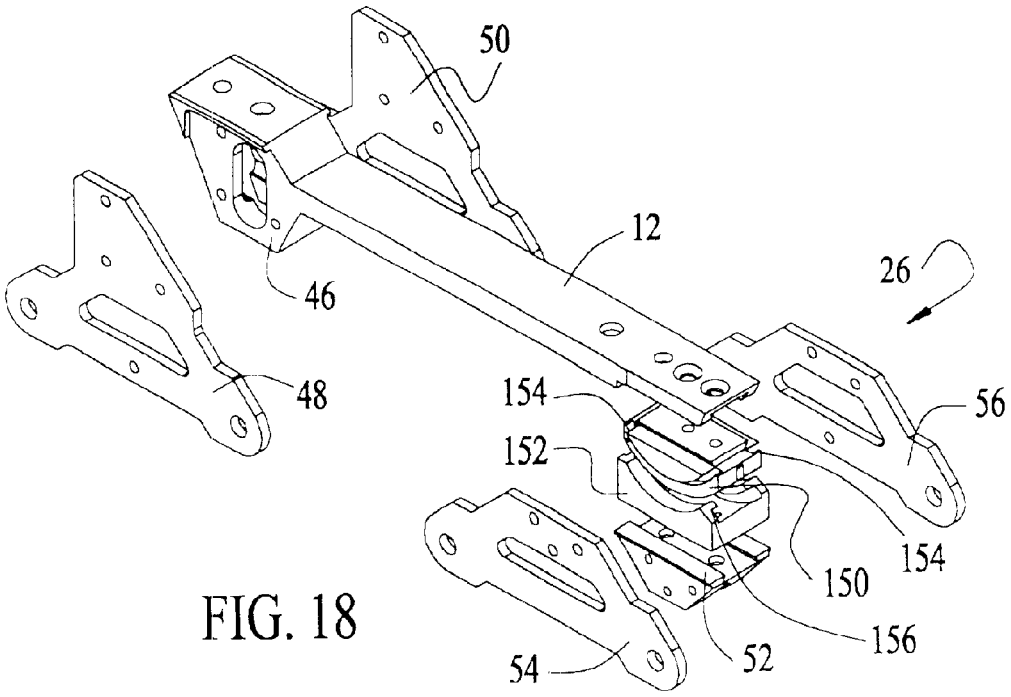
FIG. 18 is an exploded perspective view of the in-line skate of FIG. 17.

A first such embodiment of the invention is shown in side elevation in FIG. 17 and then in an exploded perspective view in FIG. 18. There, the carriage frame 26 is pivotally coupled to the main skate frame 12 by a slidable engagement between a base member 150 with an external curve and a pivot block 152 with an internal curve. The base member 150 is fixed to or integrally formed with the main skate frame 12 while the pivot block 152 is fixed to or formed integrally with the spacer block 52 between the mounting plates 54 and 56. The external curve of the base member 150 matches the internal curve of the pivot block 152 so that the two can slide easily relative to one another. Also, the base member 150 has a pair of engaging shoulders 154 that slidably mate with an arcuate C-channel 156 on the pivot block 152. With this, the pivot block 152 is securely yet slidably coupled to the base member 150. To allow the base member 150 and the pivot block 152 to slide most easily relative to one another, lubrication may be interposed therebetween. Alternatively, either or both of the base member 150 and the pivot block 152 can be coated with a low friction material, such as low friction plastic.

Under this arrangement, as FIG. 17 indicates most clearly, the carriage frame 26 is pivotally coupled to the main skate frame 12 to pivot about an effective pivot axis 28 that is displaced from the actual arc about which the two are coupled. Indeed, this structure allows the effective pivot axis 28 to be located displaced above the main skate frame 12 as was accomplished by the enlarged portion 44 and the elevated retaining plateau 78 of earlier embodiments while eliminating the weight and bulk associated therewith. Even more advantageously, the location of the effective pivot axis 28 can be manipulated by an adjustment of the radius of curvature of the curves on the base member 150 and the pivot block 152 and, possibly, by an adjustment of the orientation of the curves.

Figure 19:
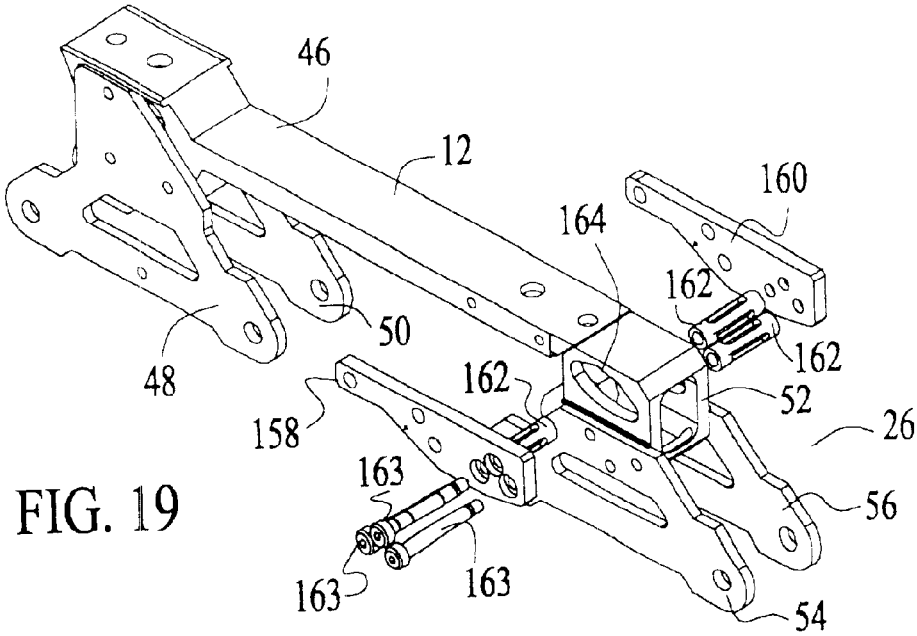
FIG. 19 is a partially exploded perspective view of another alternative embodiment of the in-line skate.

An alternative means for creating a physically displaced effective pivot axis 28 is depicted in the exploded perspective view of FIG. 19. There, the spacer block 52 again is interposed between the mounting plates 54 and 56. However, in this embodiment, first and second pivot support plates 158 and 160 are fixed to opposite sides of the main skate frame 12. Indeed, the first and second pivot support plates 158 and 160 are integrally formed with the main skate frame 12 from a single piece of material. With this, the first and second pivot support plates 158 and 160 are disposed on opposite sides of the spacer block 52 to retain the pivot block 52 and thus the carriage frame 26 in a pivoting relationship relative to the main skate frame 12. To accomplish this pivoting relationship, the pivot block 52 has an arcuate passage 164 extending laterally therethrough. Cylindrical pivot support rollers 162 are rotatably retained on axles 163. Each axle 163 passes through the arcuate passage 164 and has first and second ends received in corresponding apertures in the first and second pivot support plates 158 and 160 respectively. With this, the pivot support rollers 162 can rotate about their respective axles 163 thereby to roll along the arcuate passage 164.

In this embodiment, three pivot support rollers 162 with corresponding axles 163 are provided. The pivot support rollers 162 and axles 163 are disposed in a triangular arrangement that has a given effective height measured from the upper peripheral edge of the what may be considered the upper pivot support roller 162 of the triad and a tangential line along the lower peripheral edges of what may be considered the base pivot support rollers 162. The arcuate passage 164 is just slightly wider along the curve of the arcuate passage than the height of that triangle in which the pivot support rollers 162 are arranged. With this construction, the carriage frame 26 can be pivoted relative to the main skate frame 12 about an effective pivot axis 28 that is displaced above the main skate frame 12 and the carriage frame 26. As the carriage frame 26 is so pivoted, the pivot support rollers 162 will tend to roll along the peripheral surfaces of the arcuate passage 164.

In an alternative embodiment, which is not expressly shown in the drawings, the pivot support rollers 162 could have substantially identical outside diameters and the arcuate passage 164 could be just slightly wider than the diameters of the pivot support rollers 162. With this, the invention could incorporate two or more pivot support rollers 162 configured to mirror the shape of the arcuate passage 164 to allow the carriage frame 26 to pivot relative to the main skate frame 12 by having the pivot support rollers 162 roll and possibly slide within the arcuate passage 164.

Figure 20:
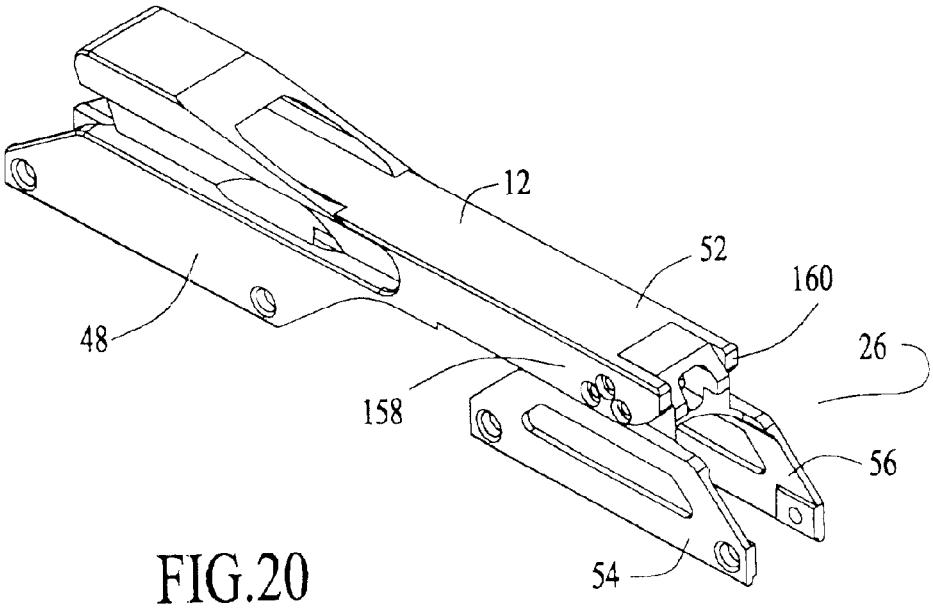
FIG. 20 is a perspective view of still another embodiment of the in-line skate.

Still another embodiment of the invention is shown in FIG. 20. There, the pivoting of the carriage frame 26 relative to the main skate frame 12 is accomplished in substantially the same way as in FIG. 19. However, in this case, the first and second pivot support plates 158 and 160 are formed integrally with the main skate frame 12. With this, the first and second pivot support plates 158 and 160 effectively comprise sides to the main skate frame 12. The spacer block 52 is again interposed between the first and second pivot support plates 158 and 160.

To still greater advantage, the present inventor has devised of what may be considered a preferred manner of eliminating all play between the carriage frame 26 and the main skate frame 12 so that the two can be moved relative to one another smoothly and with no undesirable up and down or other disadvantageous movement therebetween. One such still further embodiment is depicted in FIG. 21 in a partially exploded view and in a cross-sectional view in FIG. 22 taken along the line 22—22 in FIG. 21.

Figure 21:
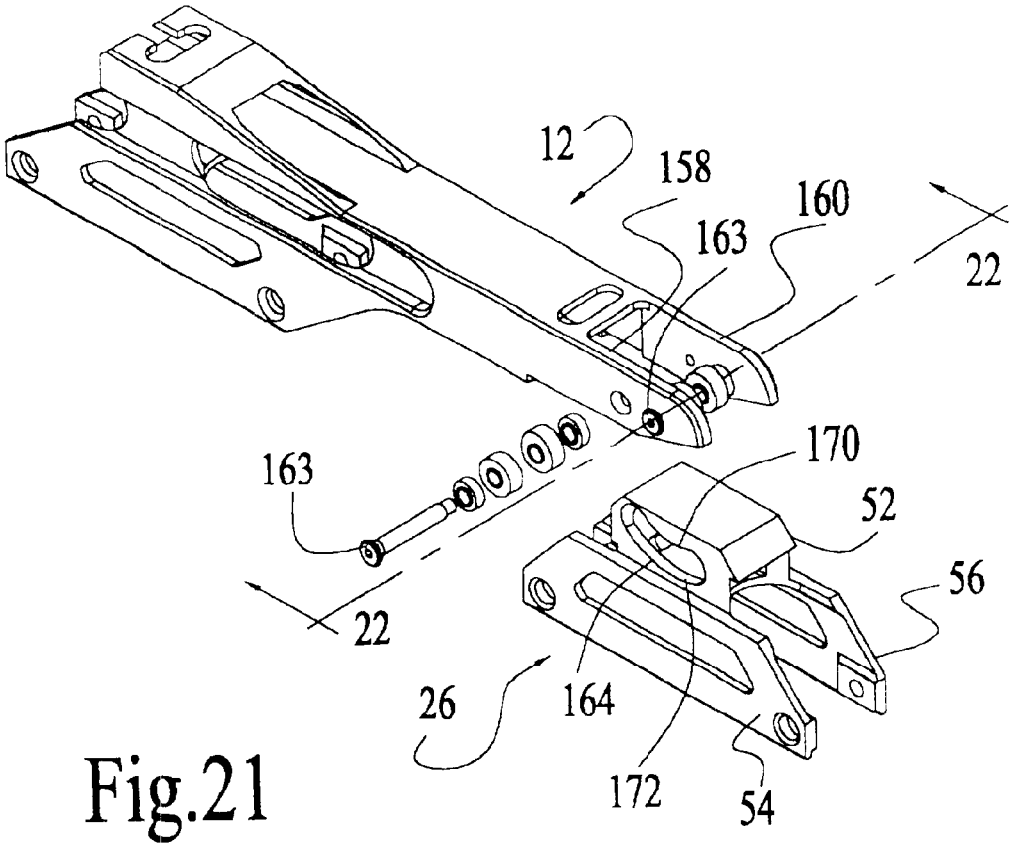
FIG. 21 is a partially exploded perspective view of a further embodiment of the in-line skate.
Figure 22:
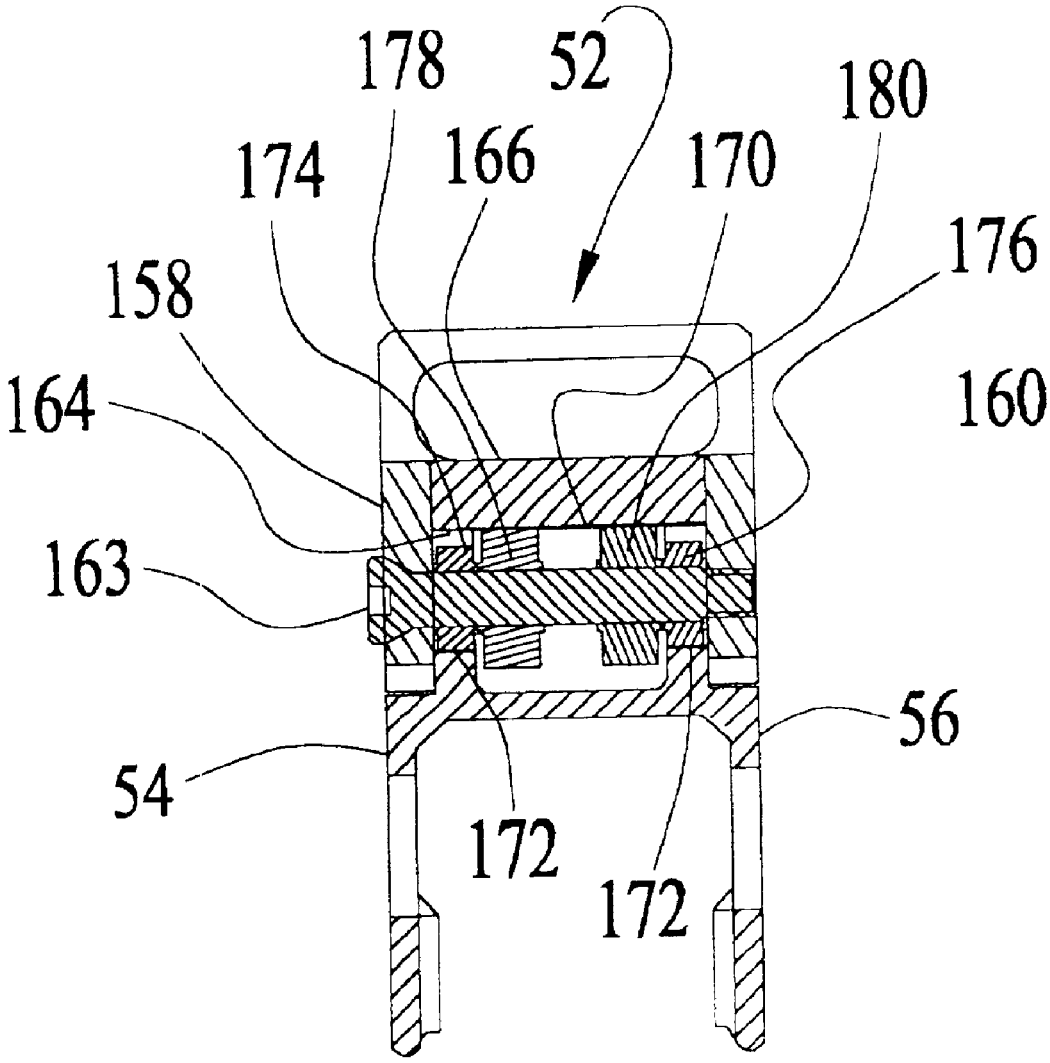
FIG. 22 is a cross section taken along the line 22—22 in FIG. 21 as the main skate frame would be coupled to the carriage frame.

In the embodiment of FIGS. 21 and 22, the in-line skate 10 advantageously eliminates all play between the carriage frame 26 and the main skate frame 12 by an opposing bearing roller arrangement wherein upper and lower surface engaging rollers are disposed on a single axle with at least one upper surface engaging roller contacting an upper boundary surface on the carriage frame 26 but not a lower engaging surface and at least one lower surface engaging roller contacting a lower boundary surface on the carriage frame 26 whereby no roller contacts both the upper and lower boundary surfaces. With this, the upper and lower surface engaging rollers can be sized to ensure a tight fit against the upper and lower engaging surfaces on the carriage frame 26 thereby allowing the carriage frame 26 to pivot smoothly relative to the main skate frame 12 with no disadvantageous play therebetween.

More particularly described, the in-line skate of FIGS. 21 and 22 again incorporates an arcuate passage 164 that passes through the walls of the pivot block 52. Axles 163 again pass through the arcuate passage 164 in the pivot block 52 and have first and second ends retained by the first and second pivot support plates 158 and 160. First and second lower surface engaging rollers 174 and 176 are rotatably disposed on each axle 163 as are first and second upper surface engaging rollers 178 and 180. As FIG. 22 shows most clearly, the first and second lower surface engaging rollers 174 and 176 contact a lower boundary surface 172 of the arcuate channel 164 while the first and second upper surface engaging rollers 178 and 180 engage an upper boundary surface 170 of the arcuate channel 164. As one sees, the upper boundary surface 170 of the arcuate channel 164 extends across a bridge portion 166 of the pivot block 52.

The first and second upper surface engaging rollers 178 and 180 are disposed inboard of the first and second lower surface engaging rollers 174 and 176 and inboard of the arcuate channel 164 such that the upper surface engaging rollers 178 and 180 cannot contact the lower boundary surface 172. The upper surface engaging rollers 178 and 180 are larger than the lower surface engaging rollers 174 and 176 such that they prevent the lower surface engaging rollers 174 and 176 from contacting the upper boundary surface 170. Also, the sum of the radius of each lower surface engaging roller 174 and 176 plus the radius of its corresponding upper surface engaging roller 178 and 180 substantially equals the height of the arcuate channel 164.

With this, constant contact is ensured between the upper surface engaging rollers 178 and 180 and the upper boundary surface 170 and between the lower surface engaging rollers 174 and 176 and the lower boundary surface 172 such that all play between the carriage frame 26 and the main skate frame 12 is avoided as the rollers 174, 176, 178, and 180 roll in opposite rotational directions along the upper and lower boundary surfaces 170 and 172 respectively. In light of the complementary nature of the radii of the upper and lower surface engaging rollers 174, 176, 178, and 180, one will appreciate that the radii can be proportionately varied so long as they add to the height of the arcuate channel 164. To be complete, one will note that, although FIG. 21 shows an arrangement with two axles 163, more or less axles 163 could be provided along with appropriately disposed and sized rollers. Of course, such embodiments are well within the scope of the present invention.

Under any of these arrangements incorporating an arcuate passage 164, the location of the effective pivot axis 28 can be controlled by a manipulation of the orientation and the radius of curvature of the arcuate passage 164. With this, the location of the effective pivot axis 28 can be moved forward, backward, up, and down by a proper shaping of the arcuate passage 164. For example, the effective pivot axis 28 can be moved farther away from the arcuate passage 164 and related pivoting structures by forming the arcuate passage 164 with a larger radius of curvature. Also, the effective pivot axis 28 can be moved forward along the in-line skate 10 by rotating the orientation of the arcuate passage clockwise when viewed in right side elevation. Of course, the effective pivot axis 28 can be moved proximally by lessening the radius of curvature of the arcuate passage 164 or rearwardly by rotating the orientation of the arcuate passage counter-clockwise again when viewed in right side elevation.

In any of the foregoing embodiments, one will appreciate that a means for biasing the carriage frame 26 to a non-pivoted orientation could be provided. For example, one or more tension springs or bands (not shown) could each have a first end coupled to the main skate frame 12 and a second end coupled to the carriage frame 26. Alternatively, one or more compression springs or other resiliently compressible structures could be appropriately interposed between the main skate frame 12 and a forward portion of the carriage frame 26. Of course, the biasing means could assume a wide variety of additional forms that would be readily obvious to one skilled in the art after reading this disclosure. Each such embodiment is well within the scope of the present invention.

Figure 23:
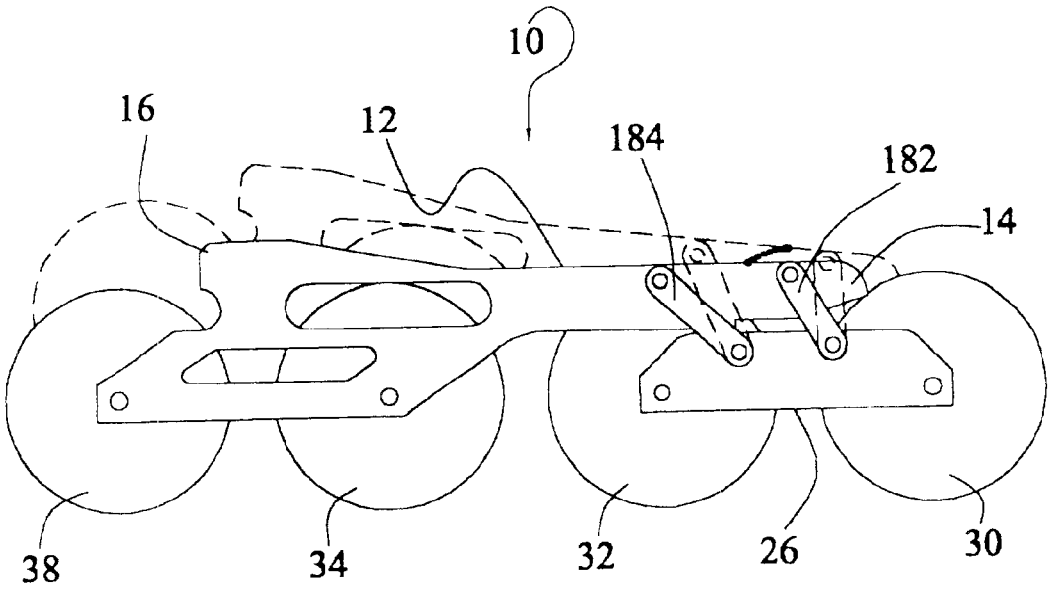
FIG. 23 is a view in side elevation of still another embodiment of the in-line skate according to the present invention.

Even further demonstrating that many different constructions would be well within the scope of the present invention is the embodiment of the in-line skate 10 of FIG. 23. There, the carriage frame 26 pivots relative to the main skate frame 12 by use of first and second pivot arms 182 and 184. As FIG. 23 illustrates, each pivot arm 182 and 184 has a first end pivotally coupled to the main skate frame 12 and a second end pivotally coupled to the carriage frame 26. In this embodiment, the first pivot arm 182 is significantly shorter than the second pivot arm 184. The first and second pivot arms 182 and 184 each may be considered to have anterior edges that face toward the anterior end 14 of the main skate frame 12 and posterior edges that face toward the posterior end 16 of the main skate frame 12. In practice, the carriage frame can pivot counter-clockwise relative to the drawing as the first and second pivot arms 182 and 184 pivot clockwise. The lengths and orientations of the first and second pivot arms 182 and 184 and their first and second ends can be manipulated to adjust the location of the effective axis of rotation of the carriage frame 26.

The astute observer will appreciate that this embodiment further illustrates that, under the present invention, the location of the effective axis of rotation of the carriage frame 26 need not necessarily be constant. Indeed, under the pivot arm embodiment of FIG. 23, it is likely that the effective axis of rotation of the overall carriage frame 26 will move as the carriage frame 26 is pivoted. Accordingly, it must be noted that the present invention and the claims that protect it include embodiments that provide for what essentially is a moving effective axis of rotation. This moving or variable axis of rotation could be accomplished in a number of manners including by the pivot arm arrangement of FIG. 23, arrangements with curves or arcuate channels 164 that have radii of curvature that vary along their lengths, or any one of a number of further mechanisms.

Figure 24:
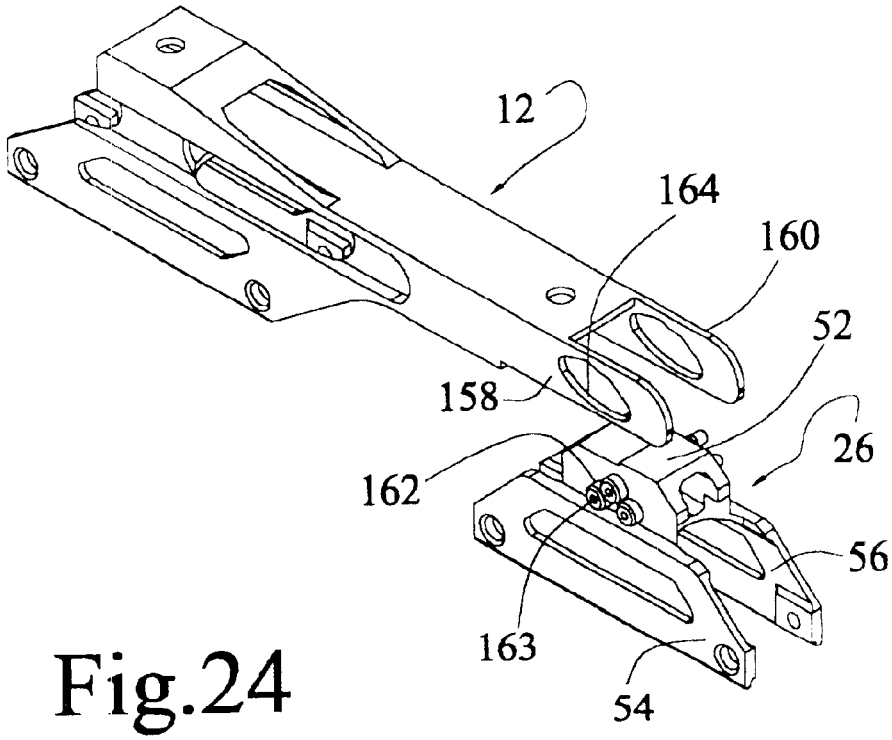
FIG. 24 is a partially exploded perspective view of yet another embodiment of the in-line skate.

Even further, one should be aware that, although the arcuate channel 164 is depicted as being in the carriage frame 26 and the axles 163 retained in place by the first and second pivot support plates 158 and 160 of the main skate frame 12, it is well within the scope of the invention for the structures to be reversed. Stated alternatively, as is shown in FIG. 24, it would be readily obvious for one to provide an arcuate channel 164 passing through the first and second pivot support plates 158 and 160 of the main skate frame 12 while having roller cylinders 162 on axles 163 disposed outboard of the pivot block 52 of the carriage frame 26.

Figure 25:
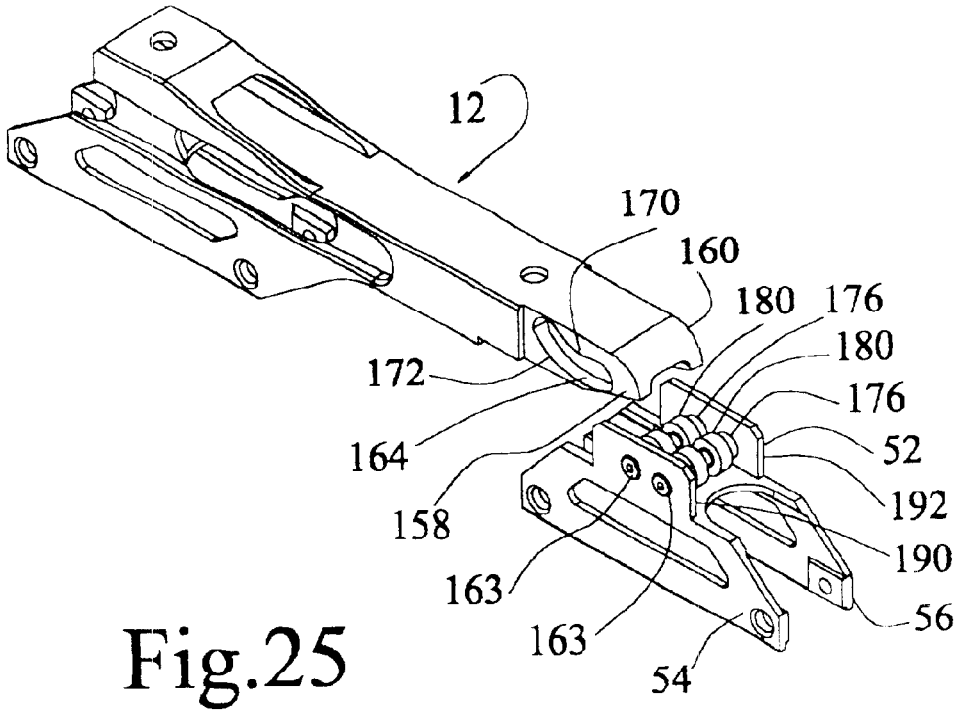
FIG. 25 is a partially exploded perspective view of an even further embodiment of the present invention for an in-line skate.

Similarly, the invention's scope includes the embodiment of FIG. 25 wherein the pivot block 52 has spaced first and second walls 190 and 192 that are disposed outboard of the first and second pivot support plates 158 and 160 and that retain the ends of axles 163. The axles 163 pass through the arcuate channel 164 that is disposed in the first and second pivot support plates 158 and 160. The axles 163 could rotatably retain cylinders (not shown) or they could retain upper and lower surface engaging rollers 174, 176, 178, and 180 that would again roll along upper and lower boundary surfaces 170 and 172. The function of this embodiment would be substantially similar to that of the embodiment of FIG. 21 except for the opposite disposition of the arcuate channel 164, the axles 163, and related structures.

Turning to FIGS. 26–30 and FIGS. 34, 35, and 37, one sees a plurality of further embodiments of the invention applied to an ice skate frame, which is indicated generally at 400. There, the ice skate 400 is founded on a main skate frame 412 with an anterior end 414 and a posterior end 416. The main skate frame 412 has a base plate 474 and first and second side plates 480 and 482. An elevated plateau 476 rises from the base plate 474 adjacent to the posterior end 416 thereof. First and second fastening apertures 472 and 470 are provided for retaining a skate boot (not shown).

Adjacent to the anterior end 414 of the main skate frame 412, the first and second side plates 480 and 482 form first and second pivot support plates 458 and 460, which pivotally support the runner carriage frame 426. A locking projection 402 extends from the lower surfaces of the first and second side plates 480 and 482 of the main skate frame 412 while a corresponding locking depression 402 is disposed on the upper surface of a ground engaging element runner tube 406. With this, inadvertent lateral movement of the main skate frame 412 relative to the runner carriage frame 426 is prevented while the two are in a non-pivoted configuration.

In any event, one will appreciate that the runner carriage frame 426 is founded on an elongate runner member 406. The runner member 406 retains a blade member 408 for contacting an ice surface. The runner member 406 and the blade member 408 could, of course, be formed integrally. Alternatively, they can be formed as separate members and joined by any appropriate means including, for example, mechanical fasteners, welding, and/or any other appropriate arrangement.

Figure 29:
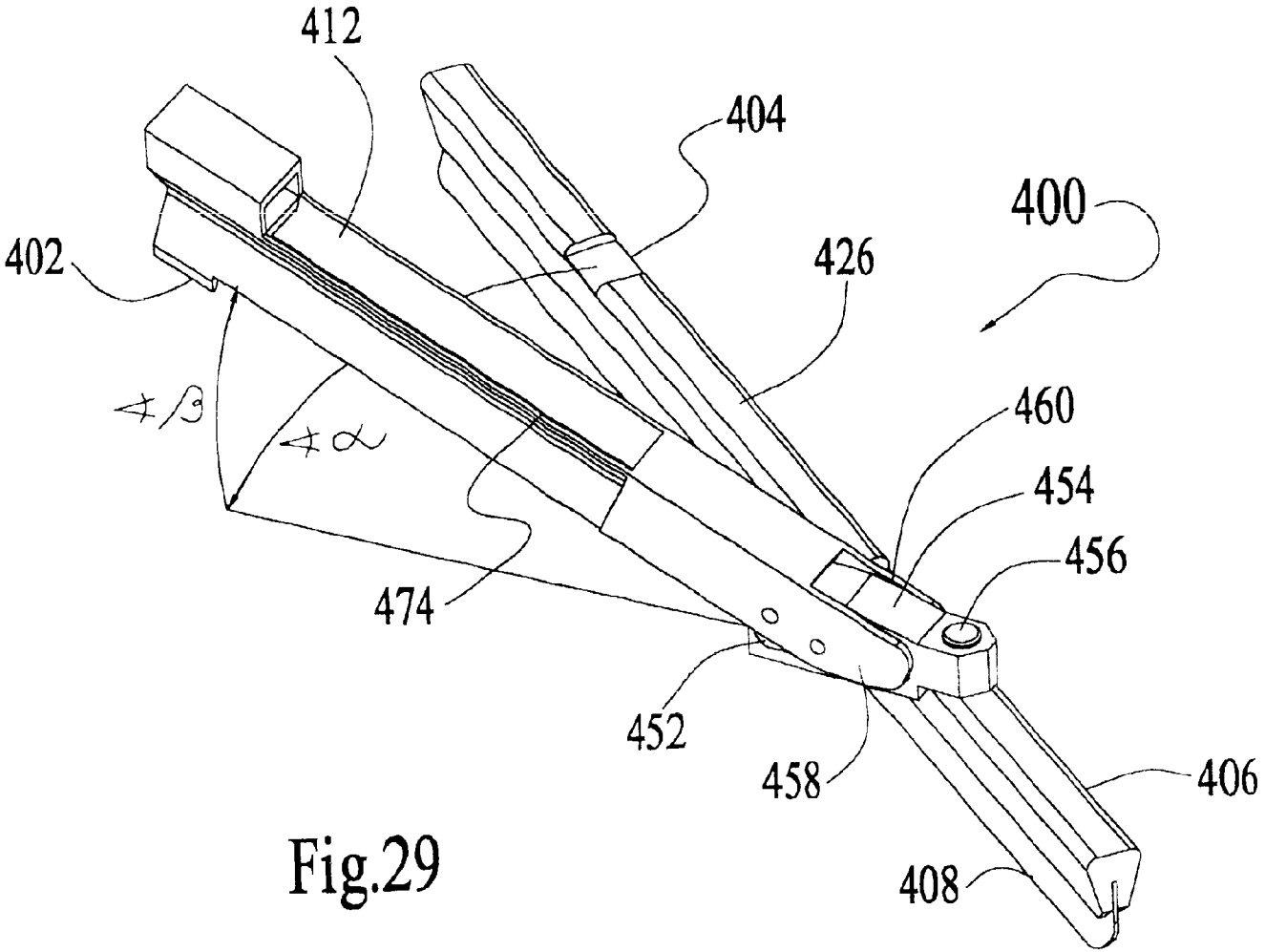
FIG. 29 is an assembled perspective view of the ice skate of FIG. 28.
Figure 30:
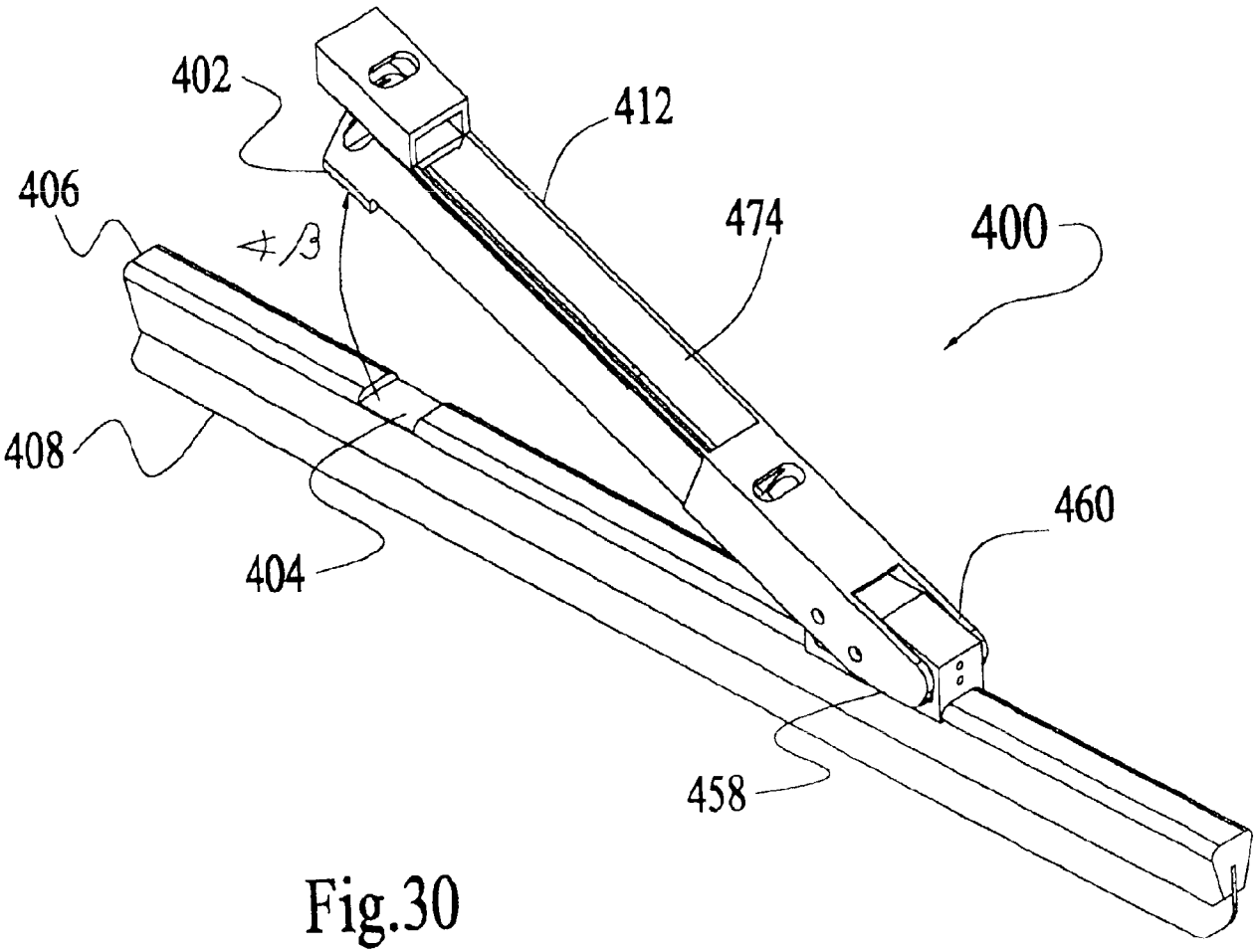
FIG. 30 is an assembled perspective view of the ice skate of FIG. 26.

For enabling most efficient propulsion, the ice skate frame 400 provides a pivoting mechanism with a means for creating a physically displaced effective pivot axis, which pivot axis is again indicated at 428 in, for example, FIGS. 29 and 30. The pivoting mechanism for creating a physically displaced effective pivot axis again enables an effective pivot axis 428 that is physically displaced from, such as above and, possibly, anterior to, the moving contacts between the main skate frame 412 and the carriage frame 426.

Figure 26:
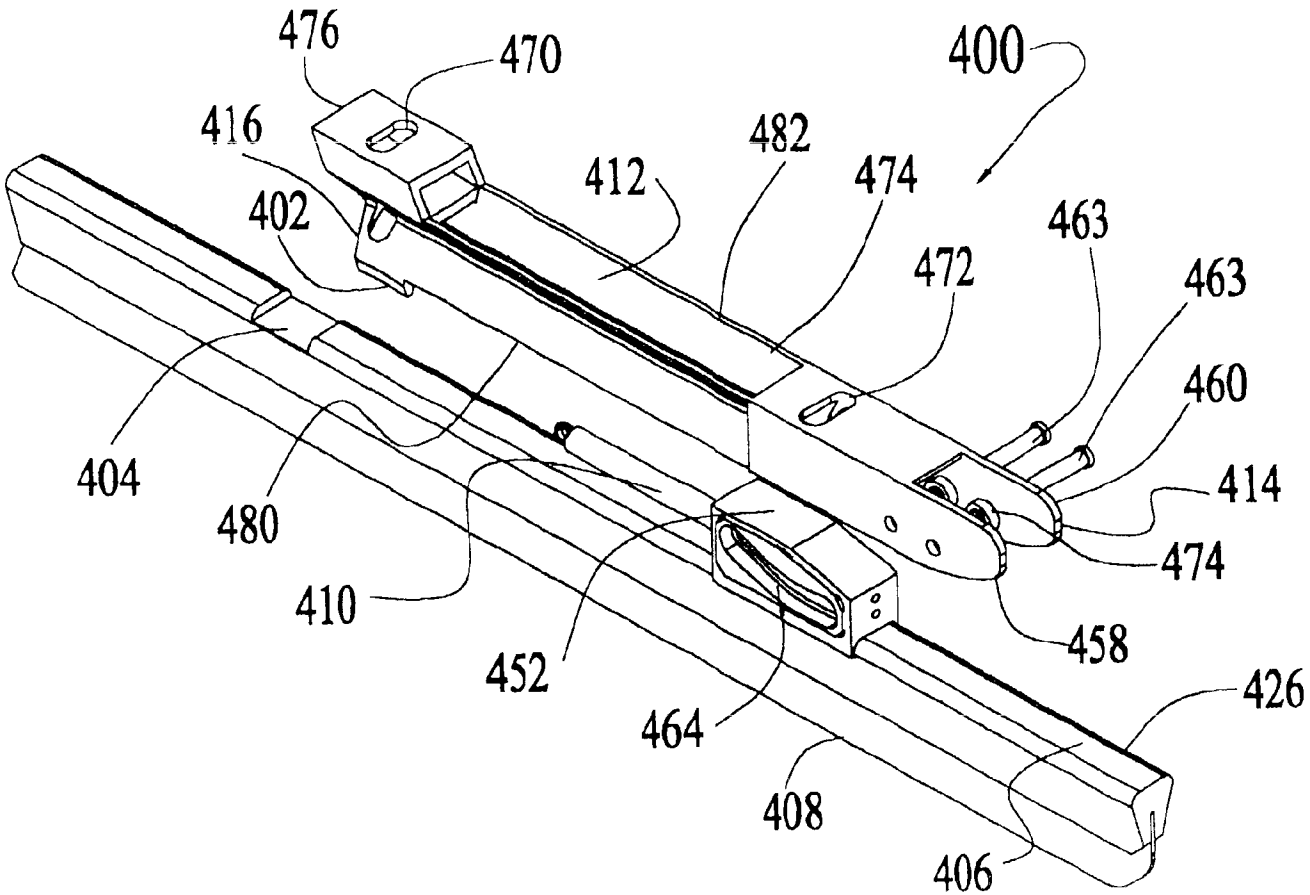
FIG. 26 is a partially deconstructed perspective view of an embodiment of the present invention shown relative to an ice skate.

Looking more particularly to the drawings, FIG. 26 shows a partially disassembled embodiment of the ice skate frame 400 designed to enable what can be termed dorsal pivoting in that it comprises, entirely or in part, a pivoting of the main skate frame 412 in what can be considered an upward direction with the posterior end 416 of the main skate frame 412 moving upwardly away from the runner member 406. FIG. 30 shows the fully assembled ice skate frame 400 of FIG. 26 in a pivoted configuration wherein the dorsal pivoting angle can be measured in terms of an angle $\beta$.

The runner carriage frame 426 is pivotally coupled to the main skate frame 412 through a main housing 452 that is interposed between the first and second pivot support plates 458 and 460. In this case, the first and second pivot support plates 458 and 460 are integrally formed with the main skate frame 412 from a single piece of material. The main housing 452 has an arcuate passage 464 extending laterally therethrough. Two axles 463 pass through the arcuate passage 464 and have first and second ends received in corresponding apertures in the first and second pivot support plates 458 and 460 respectively. As with the in-line skate 10 of previous embodiments, the ice skate frame 400 eliminates play between the runner carriage frame 426 and the main skate frame 412 by an opposing bearing roller arrangement 474 that is essentially identical to the arrangement of FIGS. 21 and 22 wherein upper and lower surface engaging rollers are disposed on a single axle with at least one upper surface engaging roller contacting an upper boundary surface on the arcuate passage 464 in the main housing 452 but not a lower engaging surface and at least one lower surface engaging roller contacting a lower boundary surface on the arcuate passage 464 in the main housing 452 whereby no roller contacts both the upper and lower boundary surfaces. With this, again with reference to FIGS. 21 and 22, constant contact is ensured between the upper surface engaging rollers and the upper boundary surface and between the lower surface engaging rollers and the lower boundary surface such that all play between the runner carriage frame 426 and the main skate frame 412 is avoided as the rollers roll in opposite rotational directions along the upper and lower boundary surfaces respectively.

Figure 36:
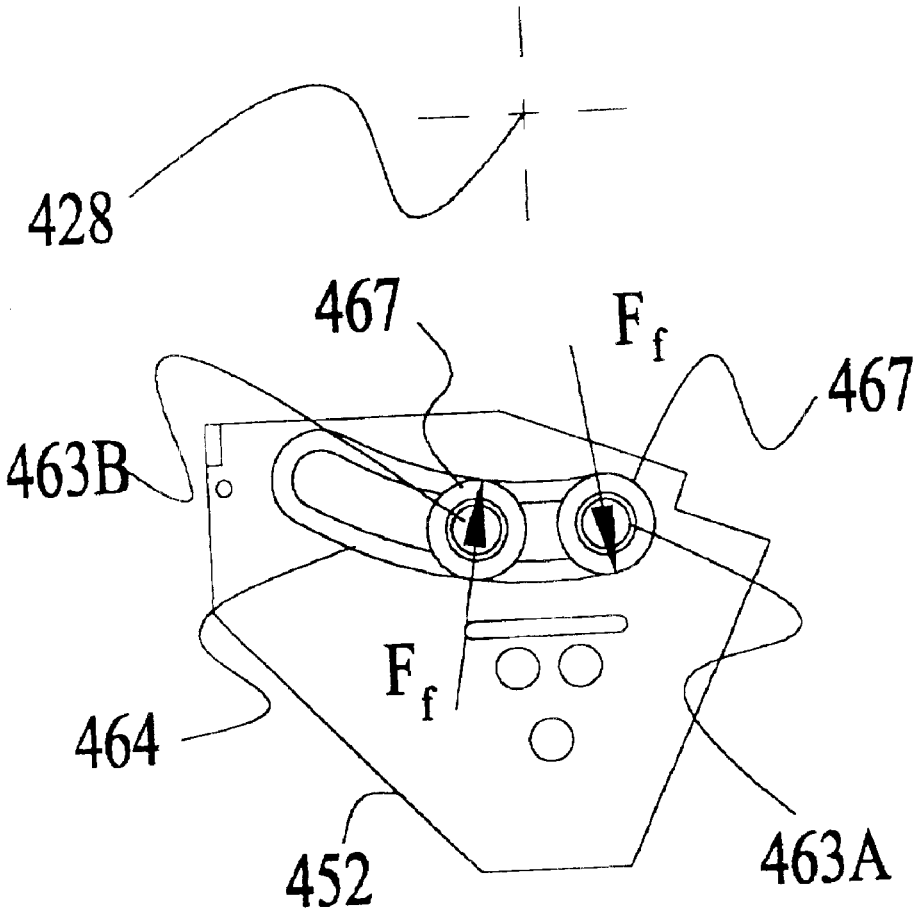
FIG. 36 is a view in side elevation of an alternative pivoting carriage frame construction.
Figure 37:
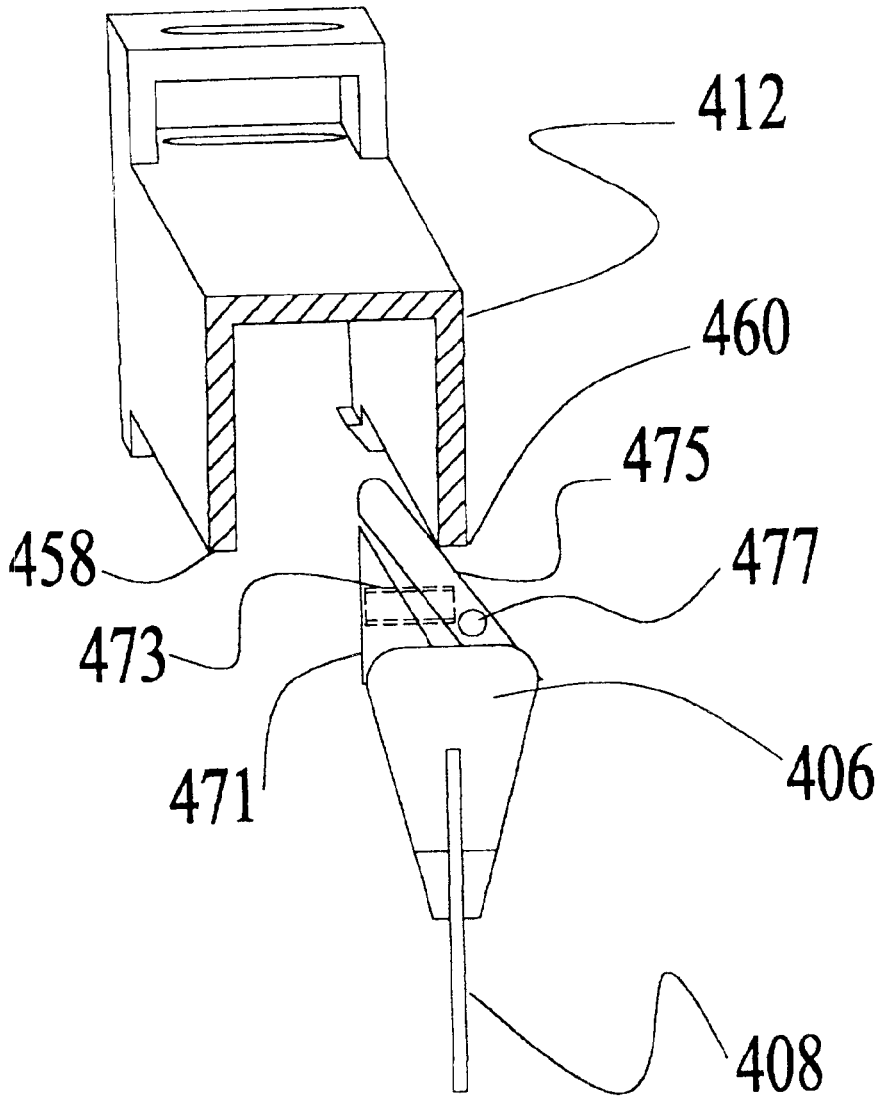
FIG. 37 is a partially sectioned view in front elevation of the ice skate frame construction of FIG. 35.

Although the opposing bearing roller arrangement 474 certainly is an effective means for carrying out embodiments of the invention, further research and development has demonstrated to the present inventor that the pivoting arrangement can be carried out as shown in the embodiment of FIG. 36. It will be understood that the arrangement of FIG. 36 is applicable to ice and in-line skate embodiments of the invention. There, one sees that there are first and second axles 463 disposed in the arcuate channel 464 for enabling the main housing 452 to pivot about a physically displaced pivot axis 428. In this case, the first and second axles 463 do not have an opposed bearing roller arrangement 474. Instead, each axle 463 has single diameter roller bearings 467 disposed thereon that have a diameter just slightly less than the surrounding height of the arcuate channel 464. To be clear, each axle 463 could have just one roller bearing 467 disposed at each end thereof or a number of roller bearings 467 disposed therealong or at the ends thereof.

It has become apparent that this embodiment is workable due to the physics involved in a typical skating stroke. As is depicted in FIG. 36 by the force arrows $F_f$, during a driving or forward portion of the skating stroke where the main skate frame 412 is pivoting away from the carriage frame 426, the forward axle 463A will tend to be pressed downwardly against the lower periphery of the arcuate channel 464 while the rearward axle 463B will tend to press against the upper periphery of the arcuate channel 464. As this happens, the upper portion of the roller bearing or bearings 467 on the forward axle 463A will lose contact with the upper periphery of the arcuate channel 464. At the same time, the lower portion of the roller bearing or bearings 467 on the rearward axle 463B will lose contact with the lower periphery of the arcuate channel 464. The opposite is true during a return portion of the skating stroke where the main skate frame pivots toward the carriage frame 426. With this, it will be appreciated that a smooth, low friction pivoting can be achieved even under this simpler arrangement.

As before, the location of the effective pivot axis 428 can be controlled by a manipulation of the orientation and the radius of curvature of the arcuate passage 464. With this, the location of the effective pivot axis 428 can be moved forward, backward, up, and down by a proper shaping and orientation of the arcuate passage 164. For example, the effective pivot axis 428 can be moved farther away by use of a larger radius of curvature and forward by rotating the orientation of the arcuate passage 464 clockwise when viewed in right side elevation.

A means for biasing the carriage frame 26 to a non-pivoted orientation could again be provided. Of course, many different biasing means could be readily devised by one skilled in the art after reviewing the present disclosure. In the embodiment of FIG. 26, the biasing means comprises a resilient member 410, such as a tension spring or band, with a first end coupled to the main housing 452 of the runner carriage frame 426 and a second end for coupling to the main skate frame 412. Alternatively, one or more compression springs or other resiliently compressible structures could be appropriately interposed between the main skate frame 412 and a forward portion of the runner carriage frame 426.

One will again note that, although the arcuate channel 464 is depicted as being in the runner carriage frame 426 and the axles 463 retained in place by the first and second pivot support plates 458 and 460 of the main skate frame 412, it is well within the scope of the invention for the structures to be disposed oppositely. As in FIG. 24, one could provide an arcuate channel 464 passing through the first and second pivot support plates 458 and 460 of the main skate frame 412 while having roller cylinders disposed outboard of the main housing 452 of the carriage frame 426.

Figure 27:
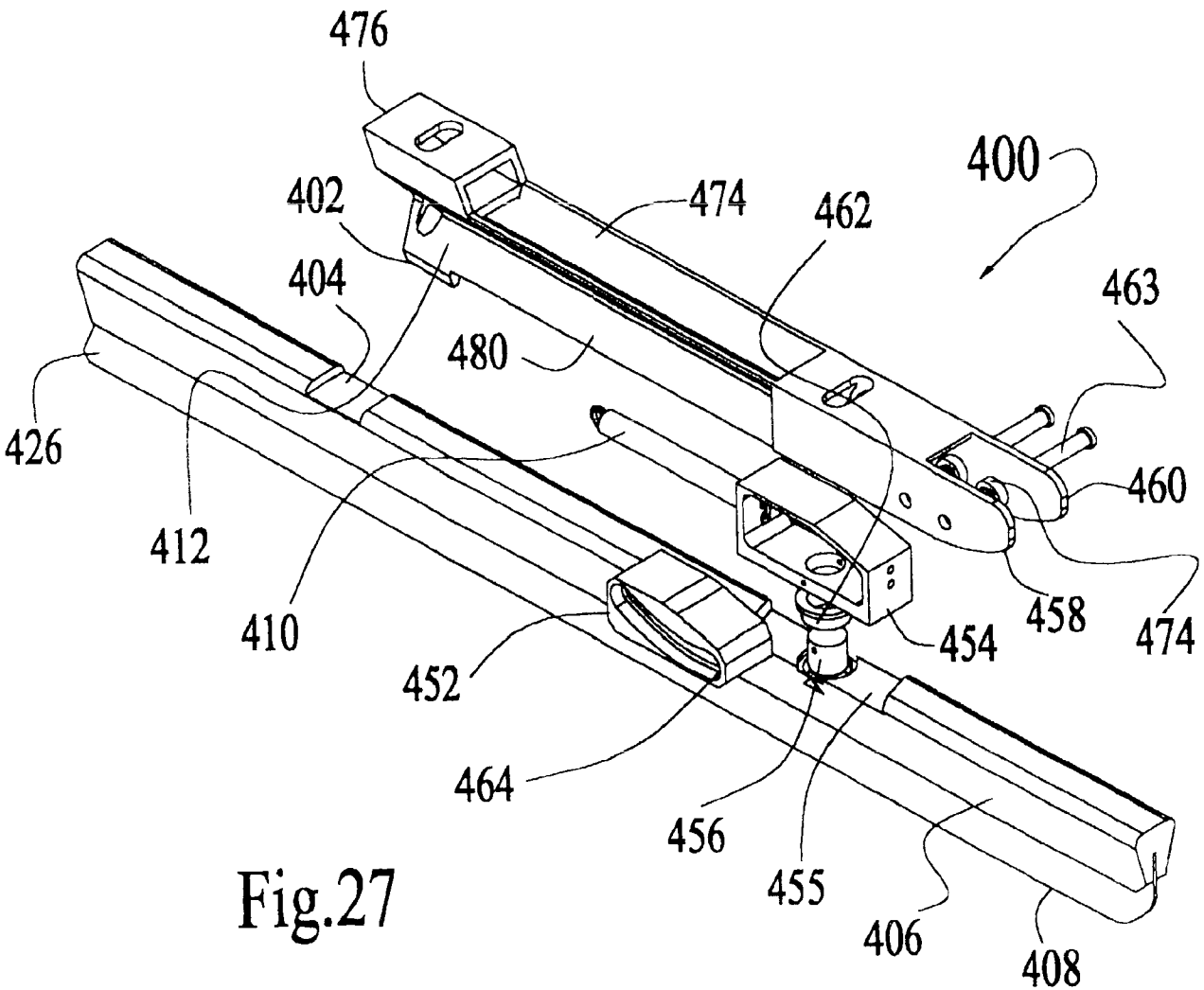
FIG. 27 is a partially deconstructed perspective view of an alternative embodiment of the invention shown relative to an ice skate.

In FIG. 27, an alternative embodiment of the ice skate frame 400 is shown partially disassembled. In this case, the ice skate frame 400 demonstrates not only dorsal pivoting but also lateral pivoting. In other words, the main skate frame 412 is enabled to pivot in an upward or dorsal direction wherein the posterior end 416 of the main skate frame 412 moves upwardly away from the runner member 406. Additionally, the main skate frame 412 is able to pivot laterally relative to the runner member 406 about a pivot axis that is adjacent to the anterior end 414 of the main skate frame 412 and the runner member 406. In this embodiment, the lateral pivoting occurs with the heel portion or posterior end 416 of the main skate frame 412 pivoting laterally outward from the posterior end of the runner member 406. For the skater's right foot, therefore, the heel portion or posterior end 416 will pivot counter-clockwise relative to the runner member 406 and the skater's path of travel. The skater's left foot would experience an opposite pivoting.

In FIG. 27, the dorsal pivoting is again achieved by means of an arcuate channel 464 in a main housing 452 that receives first and second axles 463 therethrough. The first and second axles 463 again have their first and second ends received and retained by apertures in first and second pivot support plates 458 and 460, and opposing bearing roller arrangements 474 again allow a pivoting motion with substantially no play between the runner carriage frame 426 and the main skate frame 412.

Although FIG. 27 depicts one preferred arrangement, one skilled in the art would likely find a number of ways to achieve the present invention's lateral pivoting obvious after reading this disclosure. Here, a lateral pivot shaft 456 has a first end fixed relative to the runner tube 406 and a second end rotatably or pivotally received through an aperture in a pivot casing 454. The pivot casing 454 is partially disposed in a pivot depression 455 in the upper surface of the runner tube 406. Advantageously, the pivot depression 455 has ends that are slightly angled to allow the pivot casing 454 and thus the main skate frame 412 to pivot through a given range until an end or the ends of the pivot casing 454 contact an end or the ends of the pivot depression. At that point, further pivoting will be prevented. Of course, numerous other means for preventing excessive pivoting could be readily devised.

A locking projection 402 again extends from the main skate frame 412 adjacent to the posterior end 416 thereof while a corresponding locking depression 404 is again provided on the upper surface of the runner member 406. The locking projection 402 and the locking depression 404 cooperate to act as a means for preventing the main skate frame 412 from pivoting relative to the runner member 406 until a given amount of dorsal pivoting of the main skate frame 412 has occurred.

Figure 28:
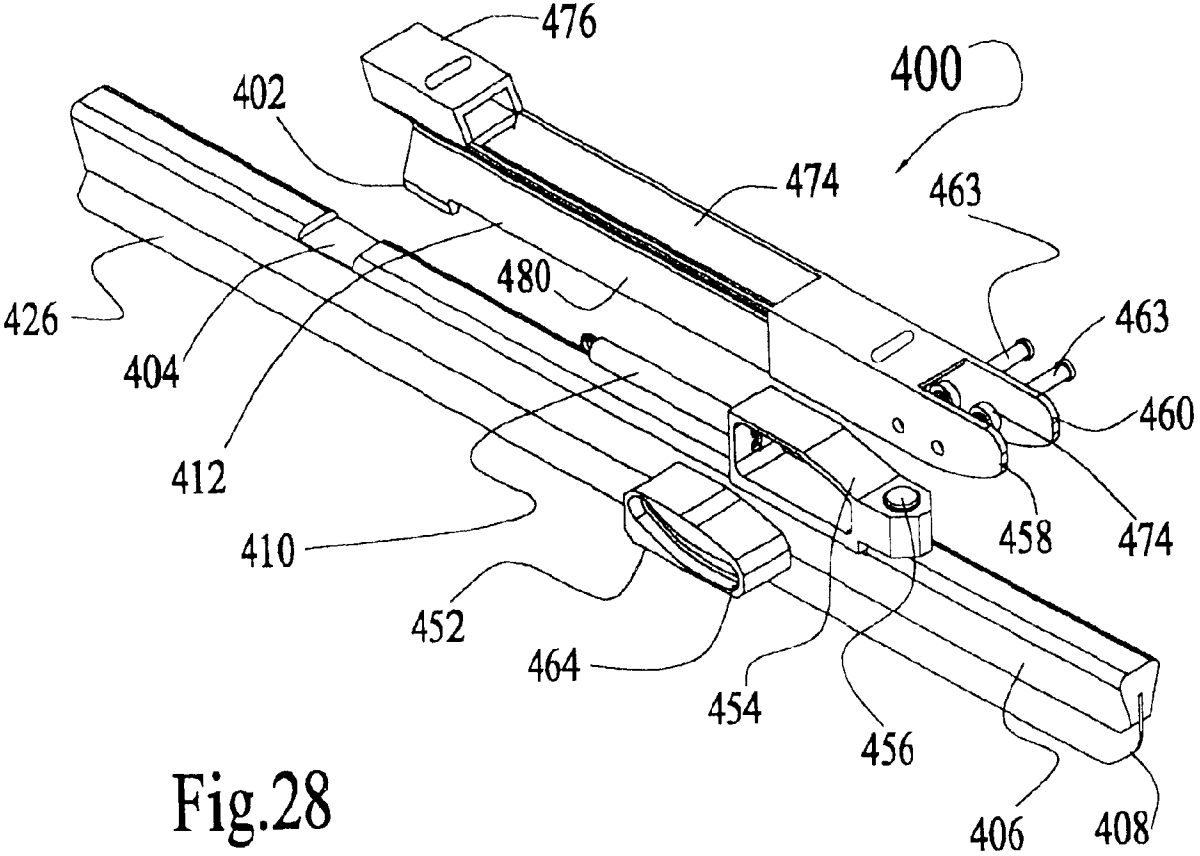
FIG. 28 is a partially deconstructed perspective view of another embodiment of the invention shown relative to an ice skate.

FIG. 28 shows another embodiment of the ice skate frame 400. This embodiment is in many respects similar to that of FIG. 27 with dorsal pivoting being achieved by the cooperative effects of an arcuate passage 464 and axles 463 and lateral pivoting being achieved by a lateral pivot shaft 456 pivotally coupling the runner member 406 and the main skate frame 412 via the pivot casing 454. In this case, however, the lateral pivot shaft 456 is disposed entirely through an anterior end of the pivot casing 454. It should be clear that, although the main housing 452 and the pivot casing 454 are shown as separate elements in these embodiments, it is well within the scope of the present invention for a single structure to act as a pivot casing 454 and to have an arcuate passage 464 therethrough so lateral and dorsal pivoting can be realized.

FIG. 29 shows the ice skate frame 400 of FIG. 28, again designed for use relative to a skater's right foot, fully assembled and with the main skate frame 412 dorsally and laterally pivoted relative to the runner member 406. FIG. 29 depicts that dorsal pivoting of the main skate frame 412 relative to the runner member 406 can be measured in terms of the dorsal pivoting angle β. Lateral pivoting of the main skate frame 412 relative to the runner member 406 can be measured in terms of a lateral pivoting angle α. In this embodiment, once the locking projection 402 has cleared the locking depression 404, the lateral pivoting angle a is not dependent on the dorsal pivoting angle β.

Figure 31:
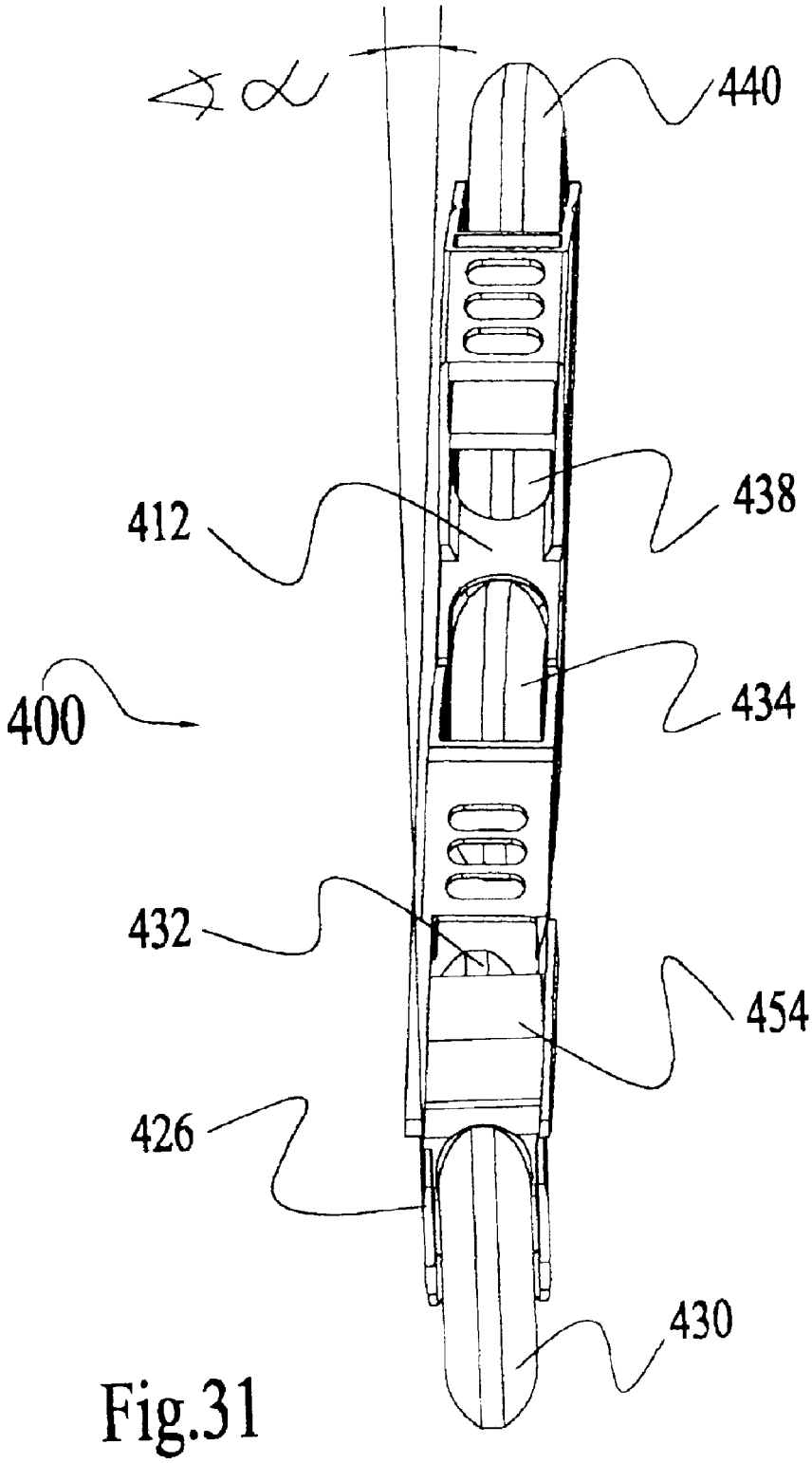
FIG. 31 is an elevated frontal view of an in-line skate according to the present invention.
Figure 32:
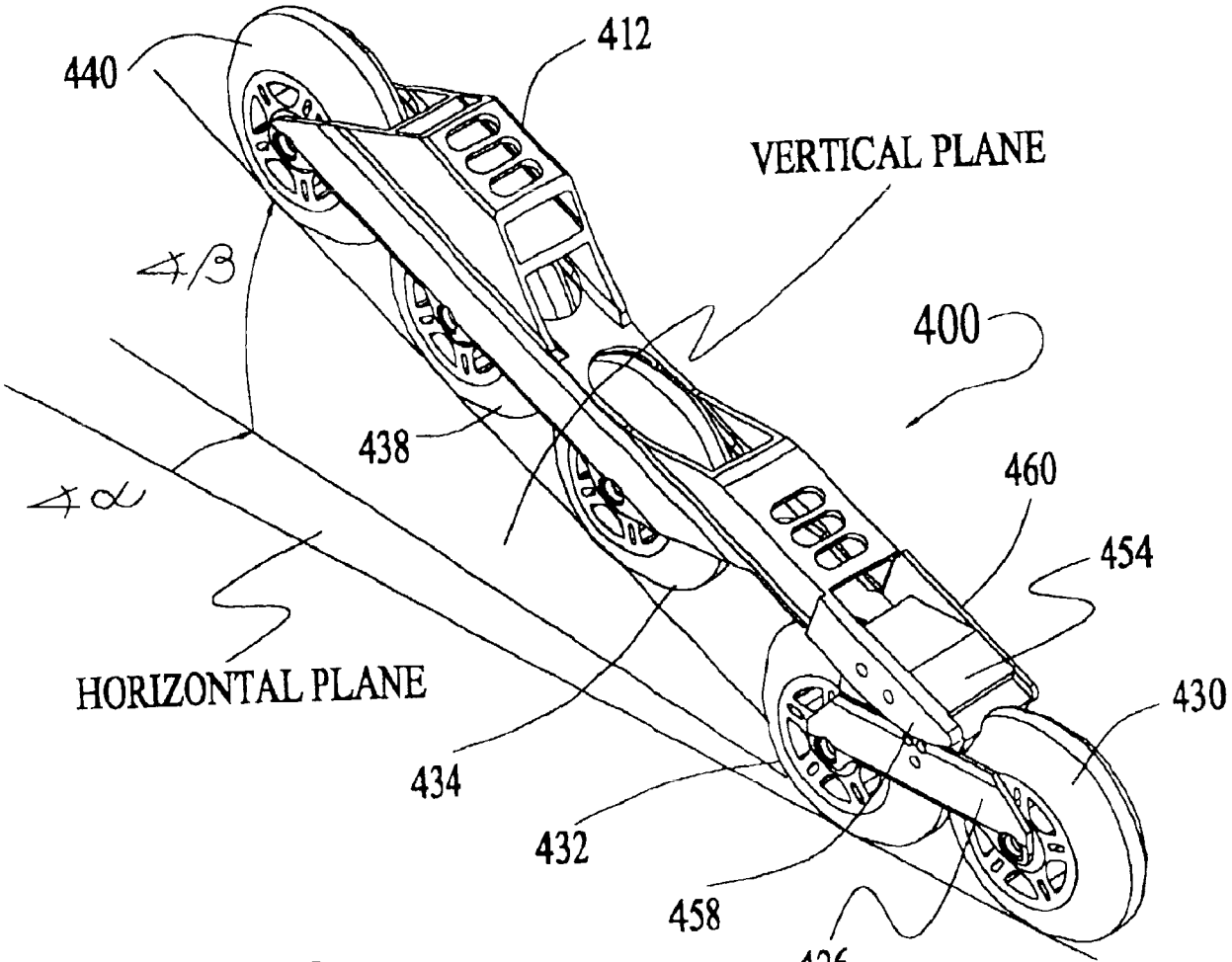
FIG. 32 is a perspective view of the in-line skate of FIG. 31.
Figure 33:
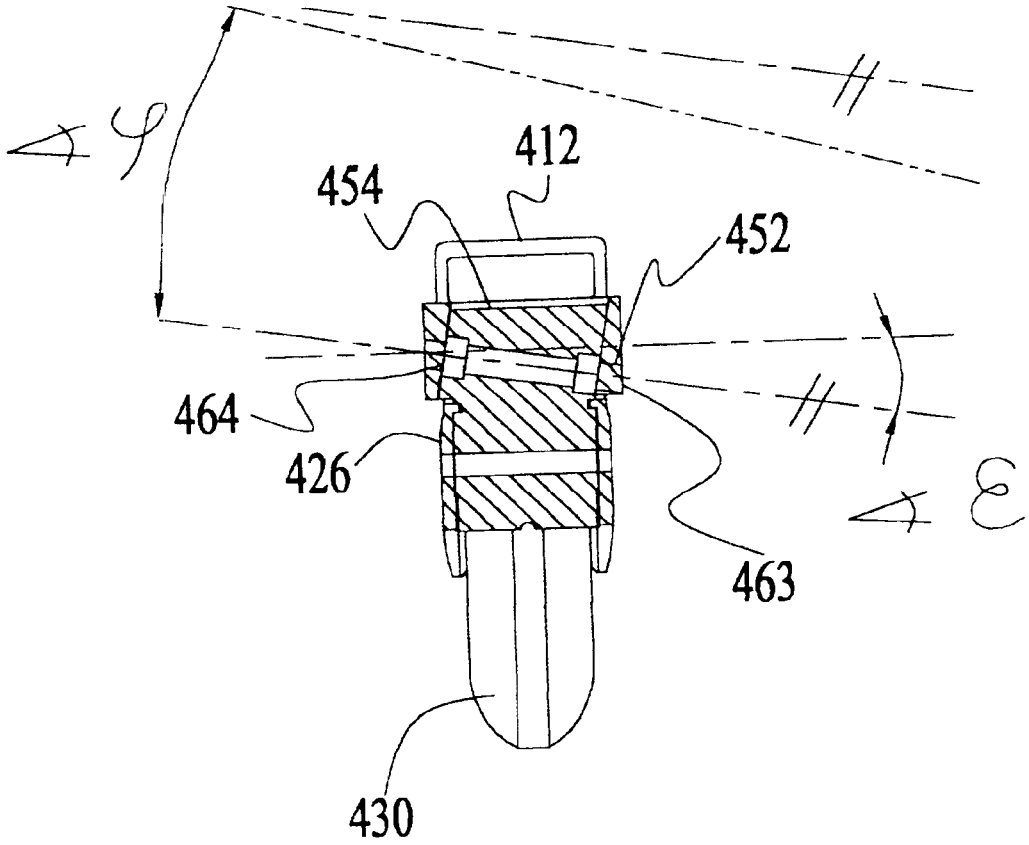
FIG. 33 is a front elevational view of the in-line skate of FIG. 31.

It should be appreciated that the lateral pivoting concepts and embodiments of the present invention are not limited to ice skate frames. For example, FIGS. 31, 32, and 33 show an alternative embodiment of the invention depicted relative to an in-line skate frame 400. The skate frame 400 has a main skate frame 412 pivotally coupled to a carriage frame 426. The carriage frame 426 retains first and second wheels 430 and 432 while the main skate frame 412 retains third, fourth, and fifth wheels 434, 438, and 440. The carriage frame 426 has a main housing 452 and pivot casing 454 that are pivotally retained relative to the main skate frame by axles 463 that have first and second ends retained by first and second pivot support plates 458 and 460.

This embodiment deviates most markedly from the previously described embodiments in that dorsal and lateral pivoting are enabled in a most simple manner by a tilting of the arcuate channel 464 in the main housing 452 along which the axles 463 travel. As shown in the cross sectional view of FIG. 33, the arcuate channel 464 is tilted by an angle E relative to horizontal. That tilting angle E can vary over the length of the arcuate channel 464 to control the degree of lateral pivoting of the main skate frame 412. For example, the tilting of the arcuate channel 464 can follow a conical path along a periphery of an imaginary cone that has a tilted centerline. This is shown in FIG. 33 where the axis of the axles 463 can be considered to be traveling along a cone with a conical angle ζ between that axis and the tilted centerline. This and other tilting patterns of the arcuate channel 464 are possible and well within the scope of the present invention.

Figure 34:
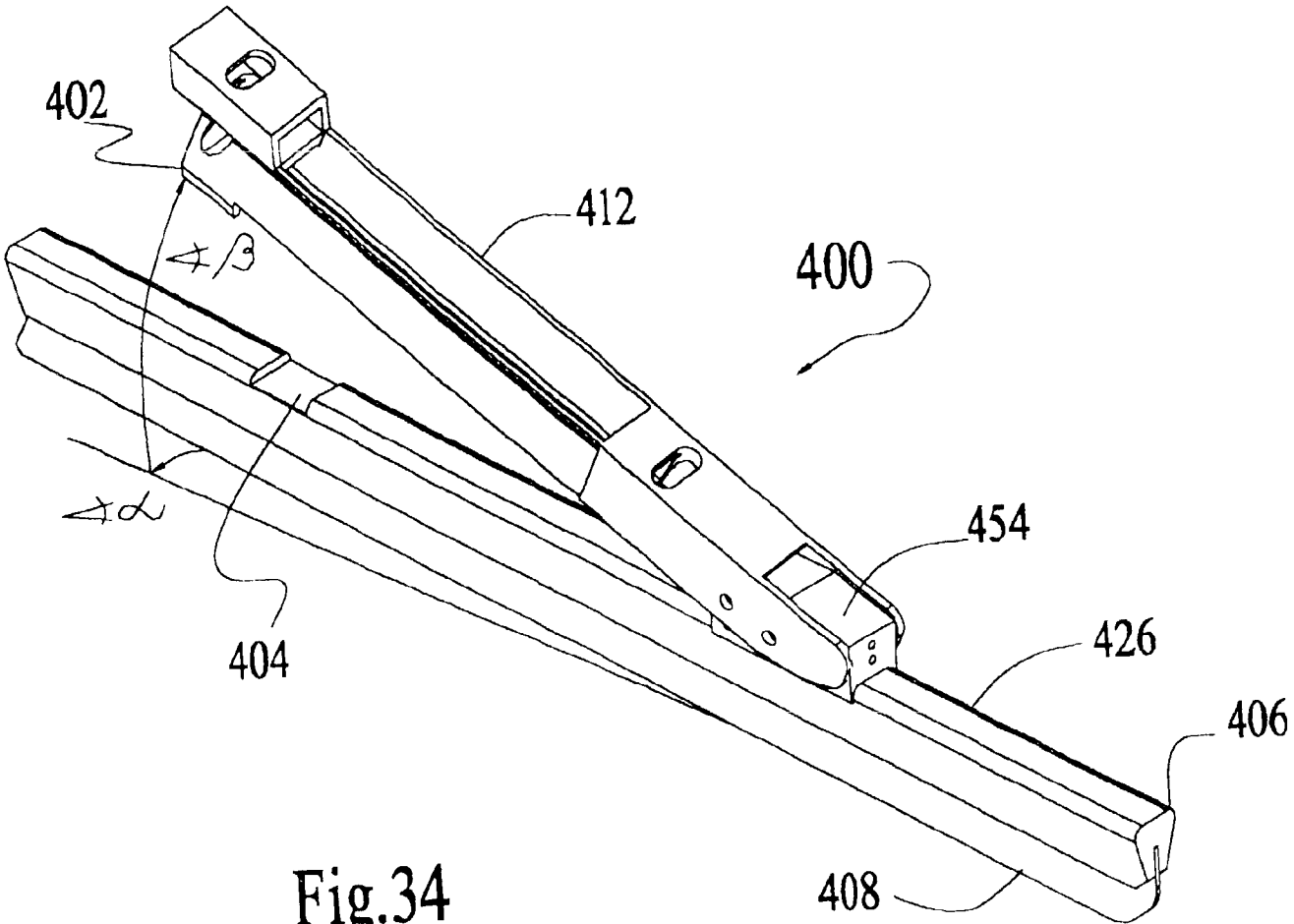
FIG. 34 is a perspective view of an ice skate according to the present invention depicting dorsal and lateral pivoting.

With this tilting of the arcuate channel 464, the main skate frame 412 will undergo a lateral pivoting through a lateral pivoting angle a as the main skate frame 412 undergoes a dorsal pivoting through a dorsal pivoting angle β. Under this arrangement, the lateral and dorsal pivoting angles α and β are dependent on one another and on the shape of the arcuate channel 464. Therefore, for a given degree of dorsal pivoting there will be a corresponding degree of lateral pivoting. Advantageously, the relative degrees of pivoting can be controlled by a proper shaping and angling of the arcuate channel 464 to suit, among other things, the needs of different users, ergonomic concerns, and different types of usage. FIG. 34 shows an embodiment of the skate frame 400 for use in ice skating wherein the dorsal and lateral pivoting angles β and α are again achieved by proper shaping and angling of the arcuate channel 464.

Figure 35:
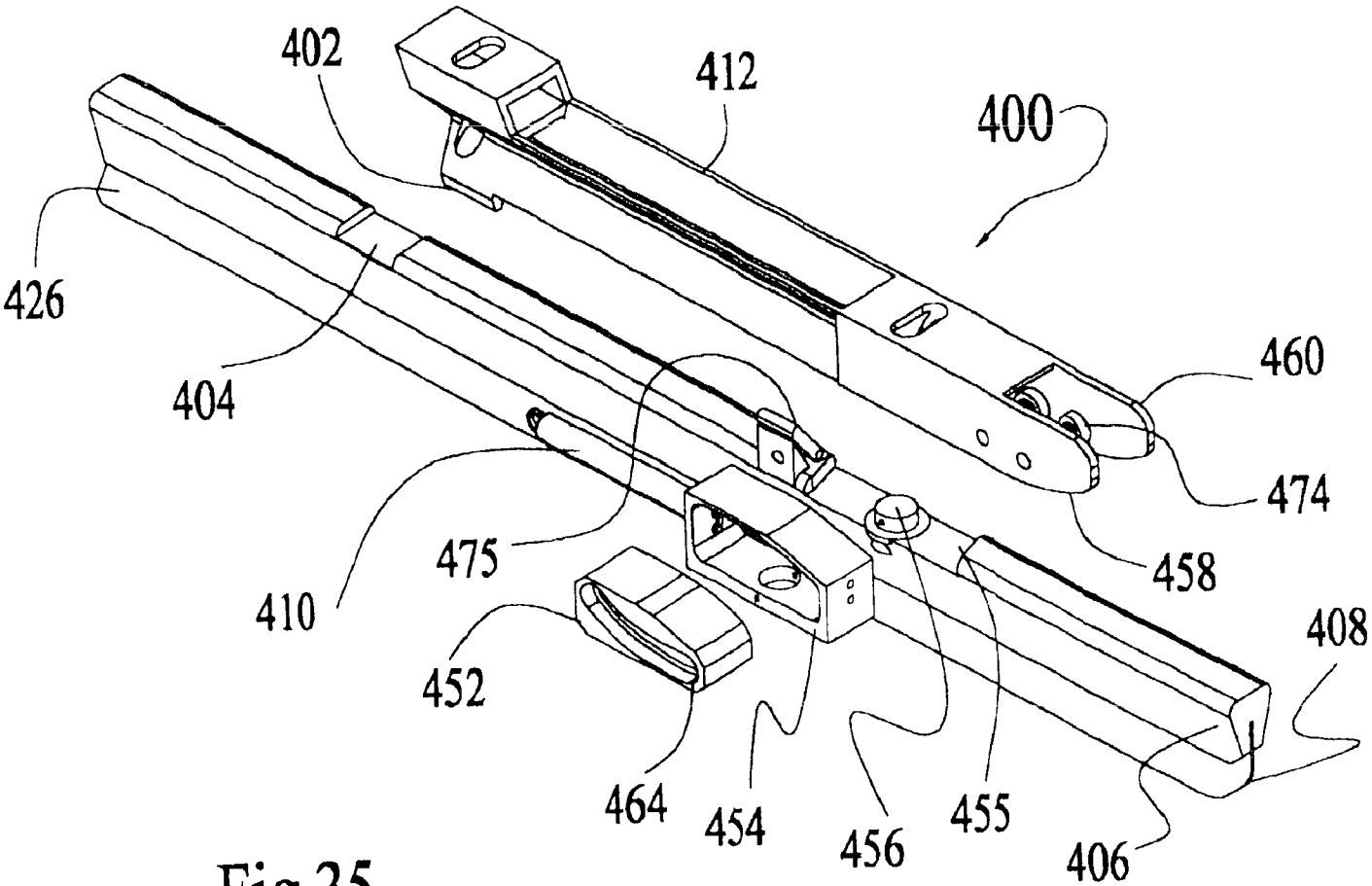
FIG. 35 is a partially deconstructed view of an ice skate under the present invention capable of dorsal and lateral pivoting.

Another embodiment of the ice skate frame 400 is shown in FIG. 35 where the main skate frame 412 is coupled for dorsal and lateral pivoting to the carriage frame 426 with an arcuate passage 464 in a main housing 452 and a pivot casing 454 with a lateral pivot shaft 456. The pivot casing 454 is again disposed in a pivot depression 455 for limiting a maximum pivoting of the main skate frame 412. In this case, however, the lateral pivoting angle α is controlled by a sloped member 475. As the main skate frame 412 pivots dorsally relative to the carriage frame 426, the main skate frame 412 will be allowed to pivot laterally as the inner surface of the second pivot support plate 460 slides along the sloped surface of the sloped member 475. With this, the greater the dorsal pivoting angle β of the main skate frame 412, the greater the degree of lateral pivoting that will be permitted.

Although the sloped member 475 could certainly be fixed at a given angle, it may be preferable to allow the angle of the sloped member 475 to be varied to suit the needs of a particular user or application. Of course, that adjustment could be carried out in a number of ways that one skilled in the art would find obvious after reading this disclosure. One presently preferred embodiment is shown in FIG. 35 and then in an enlarged view in FIG. 37. There, one sees that the sloped member 475 is pivotable about a pivot 477 and is disposed adjacent to a wedge-shaped lateral support block 471. A threaded member 473, such as a screw, is threadedly engaged with the support block 471. A first end of the threaded member 473 has a head, such as an Allen, Phillips, or other head, for being engaged by a driver (not shown). A second end of the threaded member 473 engages the proximal surface of the sloped member 475. With this, the angle of the sloped member 475 can be varied by a selective rotation of the threaded member 473. Under this arrangement, as the tilting of the sloped member 475 is increased or decreased, the proportional degree of lateral pivoting of the main skate frame 412 for each degree of dorsal pivoting will be correspondingly increased or decreased.

From the foregoing, it will be clear that the present invention has been shown and described with reference to certain preferred embodiments that merely exemplify the broader invention revealed herein. Certainly, those skilled in the art can conceive of alternative embodiments. For instance, those with the major features of the invention in mind could craft embodiments that incorporate those major features while not incorporating all of the features included in the preferred embodiments.

With this in mind, the following claims are intended to define the scope of protection to be afforded the inventor, and the claims shall be deemed to include equivalent constructions insofar as they do not depart from the spirit and scope of the present invention. A plurality of the following claims may express certain elements as a means for performing a specific function, at times without the recital of structure or material. As the law demands, these claims shall be construed to cover not only the corresponding structure and material expressly described in the specification but also equivalents thereof.

I claim as deserving the protection of Letters Patent:

1. A skate comprising:

a skate body with an anterior toe end and a posterior heel end;

a carriage frame pivotally coupled to the skate body to pivot about a pivot axis wherein the pivot axis has a horizontal position and a vertical position wherein the horizontal position of the pivot axis of the carriage frame is substantially coincident with or anterior to the anterior toe end of the skate body;

at least one ground engaging element coupled to the carriage frame;

whereby the at least one ground engaging element can pivot with the carriage frame relative to the skate body to maintain contact with a ground surface throughout a range of pivoting of the skate body relative to the ground surface.

2. The skate of claim 1 wherein the ground engaging element comprises an ice skate runner member.

3. The skate of claim 1 further comprising a biasing means for exerting a biasing force for biasing the ground engaging element toward a position adjacent to the skate body.

4. The skate of claim 1 wherein the skate body comprises a skate boot with an anterior toe end, a posterior heel end, a sole, and an open inner volume of a given length for receiving a skater's foot and wherein the vertical position of the pivot axis of the carriage frame is distal to the sole of the skate boot relative to the ground engaging element of the skate.

5. A skate comprising:

a skate body comprising a skate boot with an anterior toe end, a posterior heel end, a sole, and an open inner volume of a given length for receiving a skaters foot;

a carriage frame pivotally coupled to the skate body to pivot about a pivot axis wherein the pivot axis has a horizontal position adjacent to the anterior end of the skate body and a vertical position wherein the vertical position of the pivot axis of the carriage frame is coincident with the sole of the skate boot;

at least one ground engaging member coupled to the carriage frame;

whereby the at least one ground engaging member can pivot with the carriage frame relative to the skate body to maintain contact with a ground surface throughout a range of pivoting of the skate body relative to the ground surface.

6. The skate of claim 5 wherein the ground engaging element comprises an ice skate runner member.

7. A skate comprising:

a skate body comprising a skate boot with an anterior toe end, a posterior heel end, a sole, and an open inner volume of a given length for receiving a skater's foot;

a carriage frame pivotally coupled to the skate body to pivot about a pivot axis;

at least one ground engaging member coupled to the carriage frame;

wherein the pivot axis has a horizontal position adjacent to the anterior end of the skate body and a vertical position wherein the vertical position of the pivot axis of the carriage frame is distal to the sole of the skate boot relative to the ground engaging member of the skate;

whereby the ground engaging member can pivot with the carriage frame relative to the skate body to maintain contact with a ground surface throughout a range of pivoting of the skate body relative to the ground surface.

8. The skate of claim 7 wherein the ground engaging element comprises an ice skate runner member.

9. The skate of claim 7 wherein the horizontal position of the pivot axis of the carriage frame is substantially coincident with or anterior to the anterior toe end of the skate body.

10. A skate comprising:

a skate body comprising a skate boot with an anterior toe end, a posterior heel end, a sole, and an open inner volume of a given length for receiving a skater's foot;

a carriage frame pivotally coupled to the skate body to pivot about a pivot axis wherein the pivot axis has a horizontal position adjacent to the anterior end of the skate body and a vertical position;

at least one ground engaging element coupled to the carriage frame whereby the at least one ground engaging element can pivot with the carriage frame relative to the skate body to maintain contact with a ground surface throughout a range of pivoting of the skate body relative to the ground surface;

wherein the pivot axis of the carriage frame is located within a preferred axis location area that is defined at a first edge by a generally vertical line drawn from a given reference point and at a second edge by a line that extends from the reference point at a given downward angle relative to horizontal away from the posterior end of the skate body wherein the reference point has a horizontal location substantially coincident with or anterior to a location that is three-tenths of the length of the open inner volume of the skate boot from the anterior end of the open inner volume of the skate boot and a vertical location approximately coincident with or distal to the sole of the skate boot relative to the at least one ground engaging element of the skate.

11. The skate of claim 10 wherein the ground engaging element comprises an ice skate runner member.

12. The skate of claim 10 wherein the horizontal location of the reference point is substantially coincident with or anterior to a location that is two-tenths of the length of the open inner volume of the skate boot from the anterior end of the open inner volume of the skate boot.

13. The skate of claim 12 wherein the line defining the second edge of the preferred axis location area extends from the reference point at a downward angle of approximately twenty-five degrees relative to horizontal.

14. The skate of claim 10 wherein the line defining the second edge of the preferred axis location area extends from the reference point at a downward angle of approximately twenty-five degrees relative to horizontal.

15. A skate comprising:

a skate body comprising a skate boot with an anterior toe end, a posterior heel end, a sole, and an open inner volume of a given length for receiving a skater's foot;

a carriage frame pivotally coupled to the skate body to pivot about a pivot axis wherein the pivot axis has a horizontal position adjacent to the anterior end of the skate body and a vertical position;

at least one ground engaging member coupled to the carriage frame whereby the at least one group engaging member coupled to the carriage can pivot with the carriage frame relative to the skate body to maintain contact with a ground surface throughout a range of pivoting of the skate body relative to the ground surface;

wherein the pivot axis of the carriage frame is located within a preferred axis location area that is defined at a first edge by a generally vertical line drawn from a given reference point and at a second edge by a line that extends from the reference point at a given downward angle relative to horizontal away from the posterior end of the skate body wherein the reference point has a horizontal location substantially coincident with or anterior to a location that is approximately coincident with or anterior to the anterior end of the open inner volume of the skate boot and a vertical location approximately coincident with or distal to the sole of the skate boot relative to the at least engaging element of the skate.

16. The skate of claim 15 wherein the ground engaging element comprises an ice skate runner member.

17. The skate of claim 15 wherein the line defining the second edge of the preferred axis location area extends from the reference point at a downward angle of approximately twenty-five degrees relative to horizontal.

18. A skate comprising:

a skate body with an anterior end and a posterior end;

a carriage frame with at least one ground engaging element;

a pivoting mechanism that pivotally couples the carriage frame to the skate body wherein the pivoting mechanism enables the carriage frame to pivot away from the skate body about an effective pivot axis that has a horizontal position and a vertical position and wherein the effective pivot axis is physically displaced from the pivoting mechanism;

whereby the carriage frame pivots about an effective pivot axis without requiring the pivoting mechanism to be located at the effective pivot axis and whereby the carriage frame can pivot relative to the skate body to maintain contact with a ground surface throughout a range of pivoting of the skate body relative to a ground surface.

19. The skate of claim 18 wherein the skate body comprises a main skate frame with a lower surface proximal to the pivoting mechanism and an upper surface distal to the pivoting mechanism and wherein the effective pivot axis is distal to the upper surface of the main skate frame relative to the carriage frame.

20. The skate of claim 19 wherein the horizontal location of the effective pivot axis is adjacent to the anterior end of the skate body.

21. The skate of claim 18 wherein the pivoting mechanism comprises a first curved surface that is fixedly associated with the skate body in relatively slidable contact with a second curved surface that is fixedly associated with the carriage frame whereby the first and second curved surfaces can slide relative to one another to allow the carriage frame to pivot relative to the skate body.

22. The skate of claim 21 wherein the first and second curves have substantially identical radii of curvature whereby the first and second curves can be closely and smoothly engaged for sliding relative to one another.

23. The skate of claim 21 wherein the first curved surface comprises an outside curve and wherein the second curved surface comprises an inside curve.

24. The skate of claim 23 further comprising a means for interlockingly engaging the first and second curves.

25. The skate of claim 24 wherein the means for interlockingly engaging the first and second curves comprises a pair of engaging shoulders in combination with a C-channel.

26. The skate of claim 18 wherein the pivoting mechanism comprises a laterally disposed arcuate passage in combination with a plurality of axles at least partially disposed in the arcuate passage whereby the carriage frame can pivot relative to the skate body by a traveling of the axles along the arcuate passage whereby the carriage frame pivots about an effective pivot axis without requiring that the pivoting mechanism be located at the effective pivot axis and whereby the carriage frame can pivot relative to the skate body to maintain contact with a ground surface throughout a range of pivoting of the skate body relative to a ground surface.

27. The skate of claim 26 further comprising at least one upper surface engaging roller surrounding at least one axle of the plurality of axles for rolling along an upper surface adjacent to the first axle but not in contact with a lower surface and at least one lower surface engaging roller surrounding at least one of the plurality of axles for rolling along the lower surface adjacent to that axle but not in contact with the upper surface.

28. The skate of claim 27 wherein the upper surface engaging roller and the lower surface engaging roller have different radii and wherein a distance between the upper surface against which the upper surface engaging roller rolls and the lower surface against which the lower surface engaging roller rolls as measured perpendicularly from the longitudinal axis of the at least one axle approximately equals a sum of the radii of the upper and lower surface engaging rollers whereby the carriage frame can pivot smoothly relative to the main skate frame but with substantially no play therebetween.

29. The skate of claim 26 wherein there are at least three axles and wherein the axles are disposed in a triangular arrangement that has a given effective height.

30. The skate of claim 26 wherein there are at least two axles disposed in alignment in the arcuate passage to have a given effective height with a forward axle and a rearward axle, wherein each axle has at least one single diameter roller bearing disposed thereon, and wherein the each roller bearing has a diameter just slightly less than the height of the arcuate channel.

31. The skate of claim 18 wherein the pivoting mechanism comprises at least first and second pivot arms wherein each of the first and second pivot arms has a first end pivotally coupled to the main skate frame and a second end pivotally coupled to the carriage frame.

32. The skate of claim 18 wherein the ground engaging element comprises an ice skate runner member.

33. A skate comprising:

a main skate frame with an anterior end and a posterior end;

a carriage frame with at least one ground engaging element wherein the carriage frame is coupled to the main skate frame adjacent to the anterior end of the main skate frame;

a lateral pivoting mechanism that couples the main skate frame to the carriage frame wherein the lateral pivoting mechanism enables the posterior end of the main skate frame to pivot laterally relative to the carriage frame; and a dorsal pivoting mechanism that couples the main skate frame to the carriage frame wherein the dorsal pivoting mechanism enables the posterior end of the main skate frame to pivot dorsally away from the main carriage frame.

34. The skate of claim 33 further comprising at least one ground engaging member coupled to the carriage frame wherein the lateral pivot mechanism comprises a lateral pivot shaft with a first end coupled to the carriage frame and a second end coupled to the at least one ground engaging member.

35. The skate of claim 33 wherein the dorsal pivot mechanism comprises a laterally disposed arcuate passage in combination with a plurality of axles at least partially disposed in the arcuate passage whereby the main skate frame can pivot dorsally relative to the carriage frame by a traveling of the axles along the arcuate passage.

36. The skate of claim 35 further comprising at least one ground engaging member coupled to the carriage frame wherein the lateral pivot mechanism comprises a lateral pivot shaft with a first end coupled to the carriage frame and a second end coupled to the at least one ground engaging member.

37. The skate of claim 35 wherein the lateral pivot mechanism comprises the laterally disposed arcuate passage in combination with the plurality of axles by means of a tilting of at least a portion of the laterally disposed arcuate passage at a tilting angle.

38. The skate of claim 37 wherein the tilting angle of the arcuate passage varies over the arcuate passage.

39. The skate of claim 38 wherein the tilting angle of the arcuate passage follows a portion of a generally conical path.

40. The skate of claim 34 further comprising a means for preventing excessive lateral pivoting of the main skate frame relative to the carriage frame.

41. The skate of claim 40 wherein the means for preventing excessive lateral pivoting of the main skate frame relative to the carriage frame comprises a pivot depression of a given length in combination with a pivot member disposed in the pivot depression wherein the pivot member has a length slightly less than the length of the pivot depression whereby the main skate frame can pivot through a given range until the pivot member contacts an end or the ends of the pivot depression.

42. The skate of claim 33 wherein the main skate frame pivots relative to the carriage frame about a pivot axis that is adjacent to the anterior end of the main skate frame.

43. The skate of claim 42 further comprising a means for controlling a degree of lateral pivoting of the main skate frame relative to the carriage frame.

44. The skate of claim 43 wherein the means for controlling the degree of lateral pivoting comprises a sloped member whereby the degree of lateral pivoting is dependent on a degree of dorsal pivoting.

45. The skate of claim 44 further comprising a means for adjusting an angle at which the sloped member is disposed whereby the degree of lateral pivoting per degree of dorsal pivoting can be adjusted.

* * * * *